US006979074B2

(12) United States Patent
Watanabe et al.

(10) Patent No.: US 6,979,074 B2
(45) Date of Patent: Dec. 27, 2005

(54) INKJET HEAD

(75) Inventors: Hidetoshi Watanabe, Tokoname (JP); Atsuo Sakaida, Gifu (JP); Atsushi Hirota, Nagoya (JP); Takayuki Yamamoto, Kagoshima-ken (JP)

(73) Assignees: Brother Kogyo Kabushiki Kaisha, Nagoya (JP); Kyocera Corporation, Tokyo (JP)

( * ) Notice: Subject to any disclaimer, the term of this patent is extended or adjusted under 35 U.S.C. 154(b) by 67 days.

(21) Appl. No.: 10/668,304

(22) Filed: Sep. 24, 2003

(65) Prior Publication Data

US 2004/0130604 A1 Jul. 8, 2004

(30) Foreign Application Priority Data

Sep. 24, 2002 (JP) ..... 2002-277396

(51) Int. Cl.[7] ..... B41J 2/14; B41J 2/045
(52) U.S. Cl. ..... 347/50; 347/68; 347/71
(58) Field of Search ..... 347/50, 57, 58, 347/68, 70–72

(56) References Cited

U.S. PATENT DOCUMENTS

| | | | | |
|---|---|---|---|---|
| 4,584,590 | A | 4/1986 | Fischbeck et al. | |
| 5,929,881 | A * | 7/1999 | Kitahara et al. | 347/70 |
| 6,276,781 | B1 * | 8/2001 | Hasegawa | 347/50 |
| 6,518,990 | B2 * | 2/2003 | Koga et al. | 347/141 |
| 6,604,817 | B2 * | 8/2003 | Isono et al. | 347/71 |
| 6,808,254 | B2 * | 10/2004 | Sakaida et al. | 347/71 |
| 2002/0113847 | A1 | 8/2002 | Takagi et al. | |
| 2003/0020787 | A1 | 1/2003 | Nakamura | |
| 2003/0112298 | A1 | 6/2003 | Sato et al. | |

FOREIGN PATENT DOCUMENTS

| | | | |
|---|---|---|---|
| CH | 1362912 | A | 8/2002 |
| EP | 1 193 070 | A2 | 4/2002 |
| JP | 9-286112 | | 11/1997 |
| JP | 11-34323 | | 2/1999 |
| JP | 3215789 | | 7/2001 |
| JP | P2002-166543 | | 6/2002 |
| JP | P2002-292860 | | 10/2002 |
| WO | WO 01/62499 | A1 | 8/2001 |

* cited by examiner

*Primary Examiner*—Manish S. Shah
*Assistant Examiner*—Geoffrey S. Mruk
(74) *Attorney, Agent, or Firm*—Oliff & Berridge, PLC

(57) ABSTRACT

An inkjet head includes a cavity plate having a plurality of pressure chambers arranged in matrix, a piezoelectric sheet laminated on the cavity plate, and a power supply board. A plurality of substantially rhombus driving electrodes are formed on the piezoelectric sheet in a matrix at positions corresponding to the pressure chambers. A first contact land extends from one of the acute angle corners of each driving electrode. The driving electrodes are arranged such that the first contact land extending from one driving electrode is placed between two driving electrodes adjacent to said one driving electrode. The power supply board has a plurality of second contact lands formed at positions corresponding to the first contact lands. The second contact lands are connected with respective ones of the first contact lands for power supply.

20 Claims, 26 Drawing Sheets

INKJET HEAD

INCORPORATION BY REFERENCE

The present disclosure relates to the subject matter contained in Japanese Patent Application No. P2002-277396, filed on Sep. 24, 2002, which is expressly incorporated herein by reference in its entirety.

BACKGROUND OF THE INVENTION

The present invention relates to an inkjet head, and more particularly to an inkjet head provided with a piezoelectric sheet having driving electrodes formed thereon at high density.

An inkjet head provided with a piezoelectric sheet is disclosed, for example, in Japanese patent application provisional publication HEI 11-34323. FIG. 1A shows a sectional view of a part of the inkjet head disclosed in the above-mentioned publication. As shown in FIG. 1A, the inkjet head has a base plate 1010 in which a plurality of pressure chambers 1001 are formed. The inkjet head further has a conductive plate 1012, a piezoelectric layer 1003, and a plurality of driving electrodes 1002, which are laminated on the base plate 1010 in this order. The driving electrodes 1002 are formed on the piezoelectric layer 1003 at positions corresponding to respective pressure chambers 1001.

In the above-identified inkjet head, driving voltage is applied between the driving electrodes 1002 and the conductive plate 1012 so that portions of the piezoelectric layer 1003, defined therebetween, deforms due to piezoelectric effect. The deformed portions of the piezoelectric layer 1003 apply pressure to ink filled in the pressure chambers 1001 to eject the ink from nozzles (not shown) of the inkjet head.

FIG. 1B is a top view of the driving electrode 1002 of the inkjet head shown in FIG. 1A. The driving electrode 1002 has a body 1004 and an extended portion 1005. The body 1004 is formed slightly smaller than the pressure chamber 1001 and is located directly above the corresponding pressure chamber 1001. The end 1006 of the extended portion 1005 is located outside the area above the pressure chamber 1001. The end 1006 of the extended portion 1005 serves as a contact portion that is to be connected with a power supply line for applying the driving voltage to the driving electrode 1002.

Generally, a flexible printed board is connected to an inkjet head configured as above for applying driving voltage to each of the driving electrodes 1002. The flexible printed board includes a plurality of contact points arranged in a line in a vicinity of one edge thereof. The flexible printed board is electrically connected with the inkjet head by connecting those contact points with the contact portions (ends 1006) of the driving electrodes 1002. Since the contact points are arranged in a line, the driving electrodes 1002 of the inkjet head are formed and arranged such that the contact portions (ends 1006) thereof are also arranged in a line in a vicinity of one edge of the piezoelectric layer 1003.

This arrangement of the ends 1006, however, requires the extended portions 1005 of the driving electrodes 1002 to be extended from the bodies 1004 thereof for significant lengths, which in turn restricts the density of the driving electrodes 1002 formed on the piezoelectric layer 1003, the density of the pressure chambers 1001 formed right below the driving electrodes 1002, and hence the printing resolution that the inkjet head can achieve.

Therefore, there is a need for an inkjet head provided with a piezoelectric sheet having driving electrodes arranged on the piezoelectric sheet at high density.

SUMMARY OF THE INVENTION

The present invention provides an inkjet head satisfying the above mentioned need.

An inkjet head according to an aspect of the invention includes a cavity plate having a plurality of pressure chambers arranged in matrix, a piezoelectric sheet laminated on the cavity plate, and a power supply board. A plurality of driving electrodes are formed on the piezoelectric sheet at positions corresponding to the pressure chambers.

A plurality of first contact lands extend from respective ones of the driving electrodes. Each of the first contact lands is located in a vicinity of the corresponding one of the driving electrodes.

The power supply board has a plurality of second contact lands formed at positions corresponding to the first contact lands. Thus, the second contact lands can be connected with respective ones of the first contact lands for power supply although the first contact lands are formed in vicinities of the respective driving electrodes.

Further, since the driving electrodes are formed at positions corresponding to the pressure chambers arranged in matrix, the driving electrodes, and hence the first contact lands thereof, are also arranged in matrix. Thus, the driving electrodes can be formed on the piezoelectric sheet at high density.

Optionally, the first contact lands may be formed so as to protrude from the piezoelectric sheet. Alternatively or additionally, the second contact lands may be formed so as to protrude from the power supply board. The first contact lands and/or the second contact lands formed as above create a clearance between the piezoelectric sheet and the power supply board attached thereon, and thereby prevent the power supply board from applying unexpected force on the driving electrodes.

Optionally, each of the first contact lands may be formed in more than two tiers. For example, each of the first contact lands may be formed so as to include a first level portion higher than the driving electrode and a second level portion higher than the first level portion. The first level portion is formed between the second level portion and the driving electrode.

In some cases, the first contact lands are formed out of areas of the piezoelectric sheet defined right above the pressure chambers, so that the mechanical connection between the first and second contact lands do not seriously affect the deforming properties of the piezoelectric sheet at portions right above respective pressure chambers.

In some cases, each of the driving electrodes has a substantially rhombus form having a pair of acute angle corners and a pair of obtuse angle corners. The driving electrodes are arranged such that the acute angle corners of one driving electrode is located between the acute angle corners of other driving electrodes adjacent to that one driving electrode.

In the above case, each of the first contact lands may be formed so as to extend from one of the acute angle corners of the driving electrode. More specifically, the driving electrodes may be arranged such that the first contact land extending from one driving electrode is placed between two driving electrodes adjacent to that one driving electrode.

In some cases, the piezoelectric sheet has at least one positioning mark that assists in positioning of the power supply board on the piezoelectric sheet such that the plurality of first contact lands make contact with the plurality of second contact lands.

Alternatively or additionally, the power supply board may have at least one positioning mark that assists in positioning of the power supply board on the piezoelectric sheet such that the plurality of first contact lands make contact with the plurality of second contact lands.

An inkjet head according to another aspect of the invention includes a body having a plurality of pressure chambers arranged in matrix, a piezoelectric sheet attached on the body, a plurality of driving electrodes formed on the piezoelectric sheet at positions corresponding to the pressure chambers, a plurality of first contact lands extending from respective ones of the driving electrodes. Each of the first contact lands is located in a vicinity that corresponds to one of the driving electrodes. These first contact lands are to be connected with respective ones of second contact lands of a printed board for power supply.

BRIEF DESCRIPTION OF THE DRAWINGS

The invention will be described with reference to the drawings, in which.

DETAILED DESCRIPTION OF PREFERRED EMBODIMENTS

Hereinafter, an inkjet head according to an embodiment of the invention will be described with reference to the accompanied embodiment.

Figure 1A:
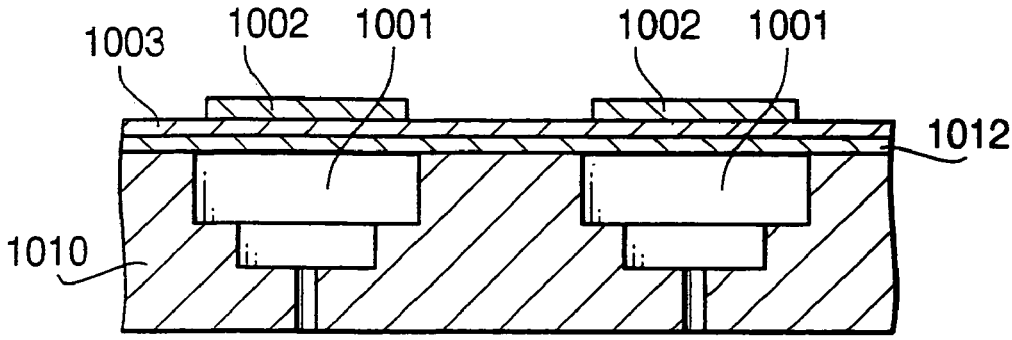
FIG.1A Prior Art
FIG. 1A shows a sectional view of a part of an inkjet head according to a prior art.
Figure 1B:
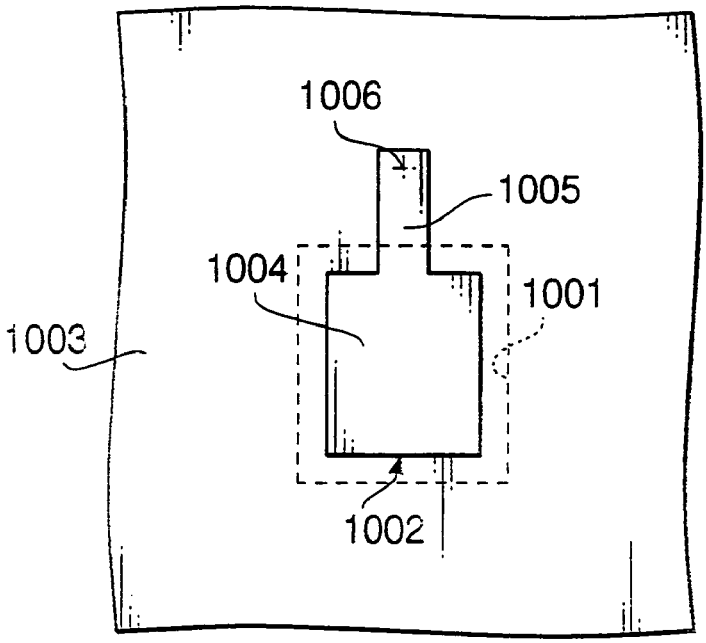
FIG.1B Prior Art
FIG. 1B is a top view of a driving electrode of the inkjet head shown in FIG. 1A.
Figure 2:
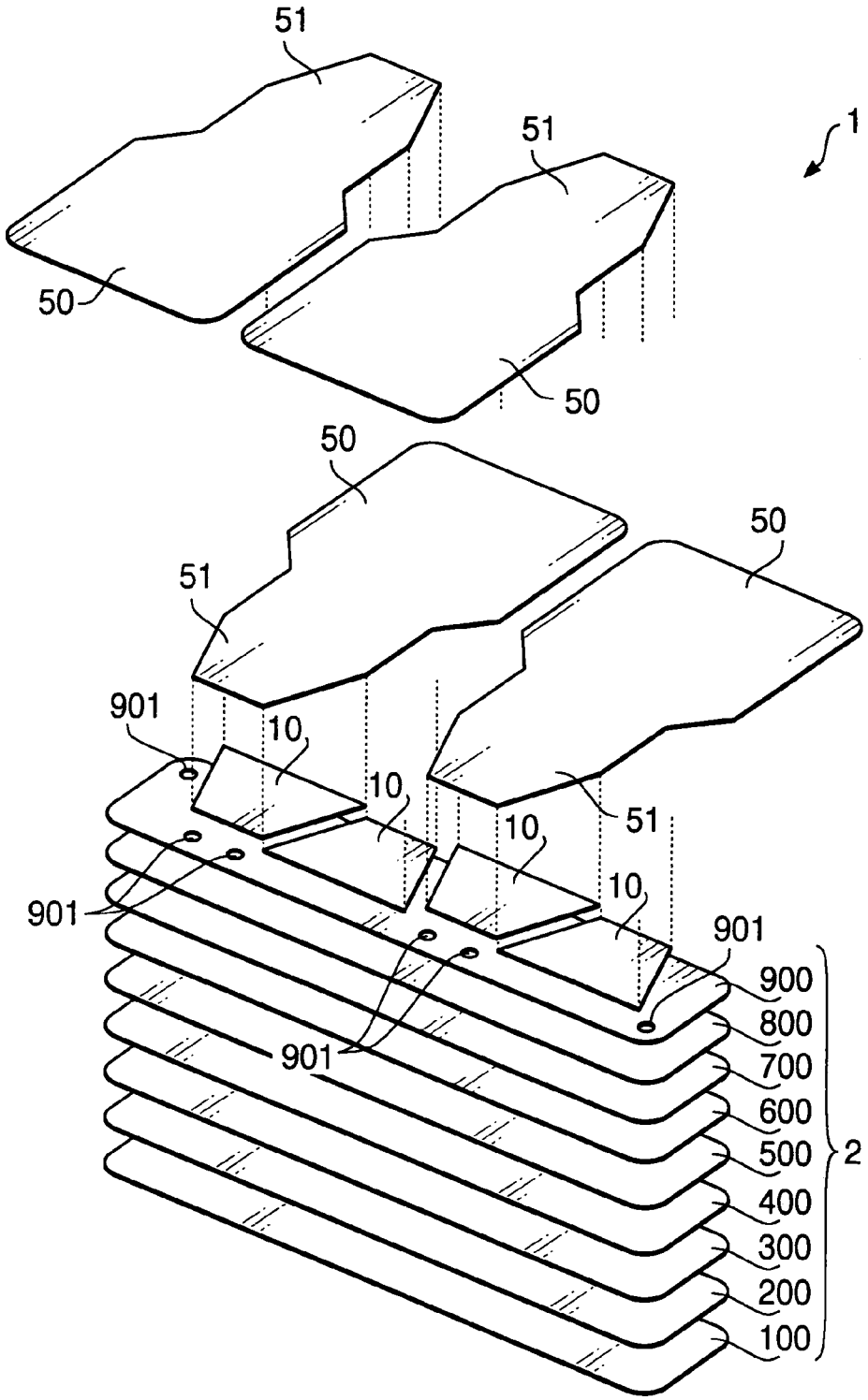
FIG. 2 is an exploded perspective view of an inkjet head according to an embodiment of the invention.

FIG. 2 is an exploded perspective view of the inkjet head 1 according to the embodiment of the invention. The inkjet head 1 includes a body 2 and four trapezoidal plate type piezoelectric sheets 10 attached on the top face of the body 2. The inkjet head 1 further includes four flexible printed boards 50, which will be referred to hereinafter as FPC boards 50. Each FPC board 50 has an extended portion 51, which is attached on the top face of the corresponding piezoelectric sheet 10 to be electrically connected with the piezoelectric sheet 10.

Figure 3:
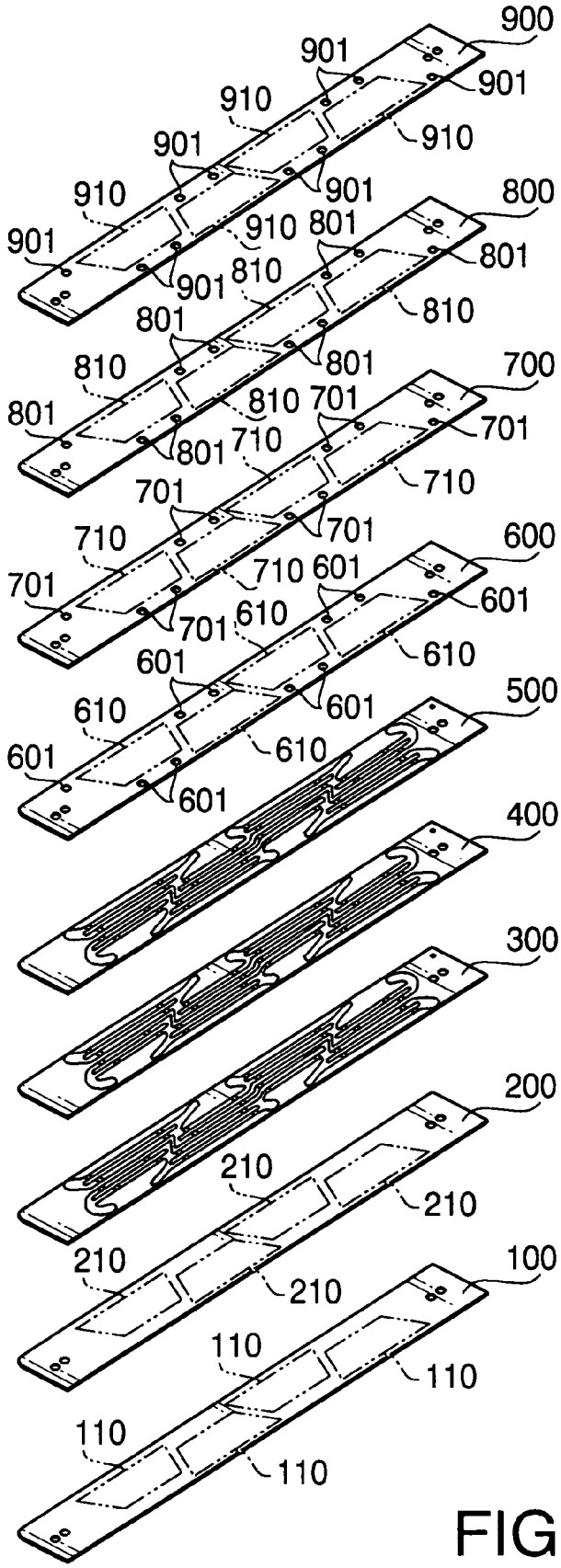
FIG. 3 is an exploded perspective view of a body of the inkjet head shown in FIG. 2.

FIG. 3 is an exploded perspective view of the body 2 of the inkjet head 1 shown in FIG. 2. The body 2 has a laminated structure composed of a plurality of substantially rectangular thin metal sheets. In the present embodiment, the body 2 is composed of nine metal sheets, which are a nozzle plate 100, a cover plate 200, first manifold plate 300, second manifold plate 400, third manifold plate 500, a supply plate 600, an aperture plate 700, a base plate 800, and a cavity plate 900.

Figure 4:
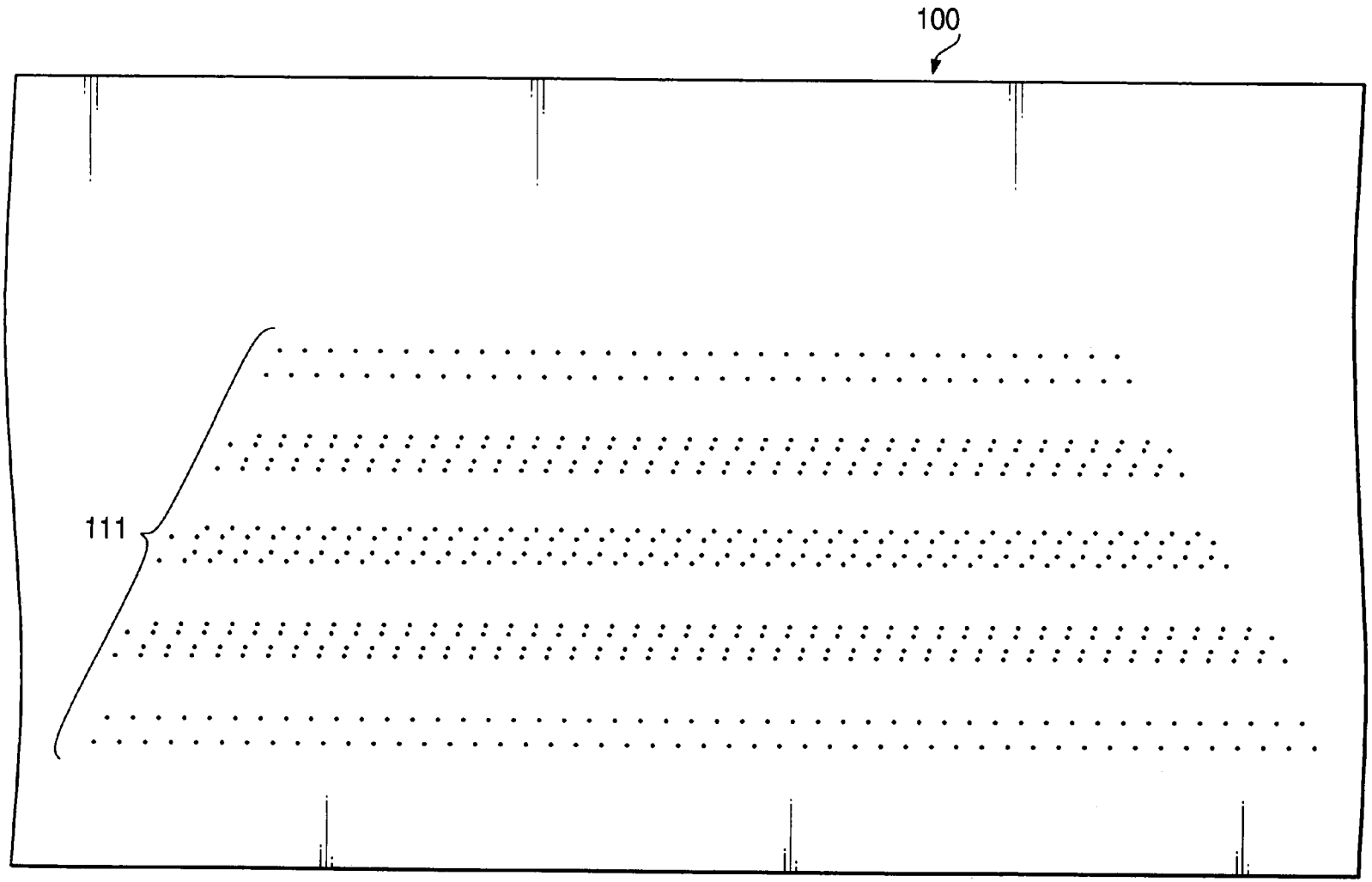
FIG. 4 is a plane view of a part of a nozzle plate of the inkjet head shown in FIG. 2.

The nozzle plate 100 has four substantially trapezoidal areas 110 defined thereon. As shown in FIG. 4, each trapezoidal area 110 is provided with a plurality of fine diameter nozzles 111 for ejecting ink formed through the nozzle plate 100. The number and arrangement of the nozzles 111 are determined in accordance with a printing resolution required for the inkjet head 1.

Figure 5:
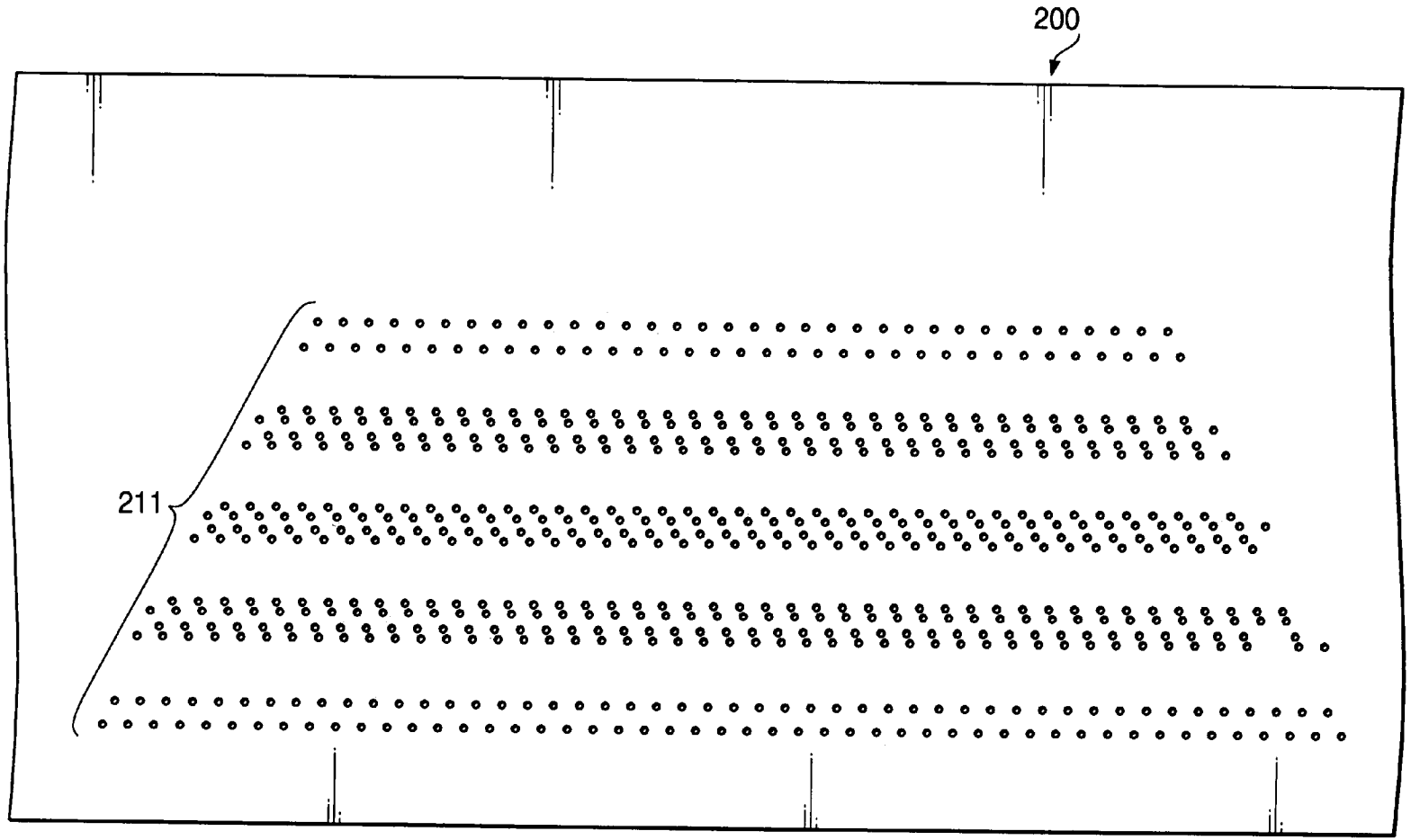
FIG. 5 is a plane view of a part of a cover plate of the inkjet head shown in FIG. 2.

Referring back to FIG. 3, a plurality of substantially trapezoidal areas 210 are defined on the top side of the cover plate 200. As shown in FIG. 5, each trapezoidal area 210 is provided with a plurality of fine diameter through holes 211, which serve as ink channels. The through holes 211 are formed at positions corresponding to respective ones of the nozzles 111 of the nozzle plate 100. Thus, when the cover plate 200 is laid on top of the nozzle plate 100, fluid communication is established between each through hole 211 and the corresponding nozzle 111 (see FIG. 28).

Figure 6:
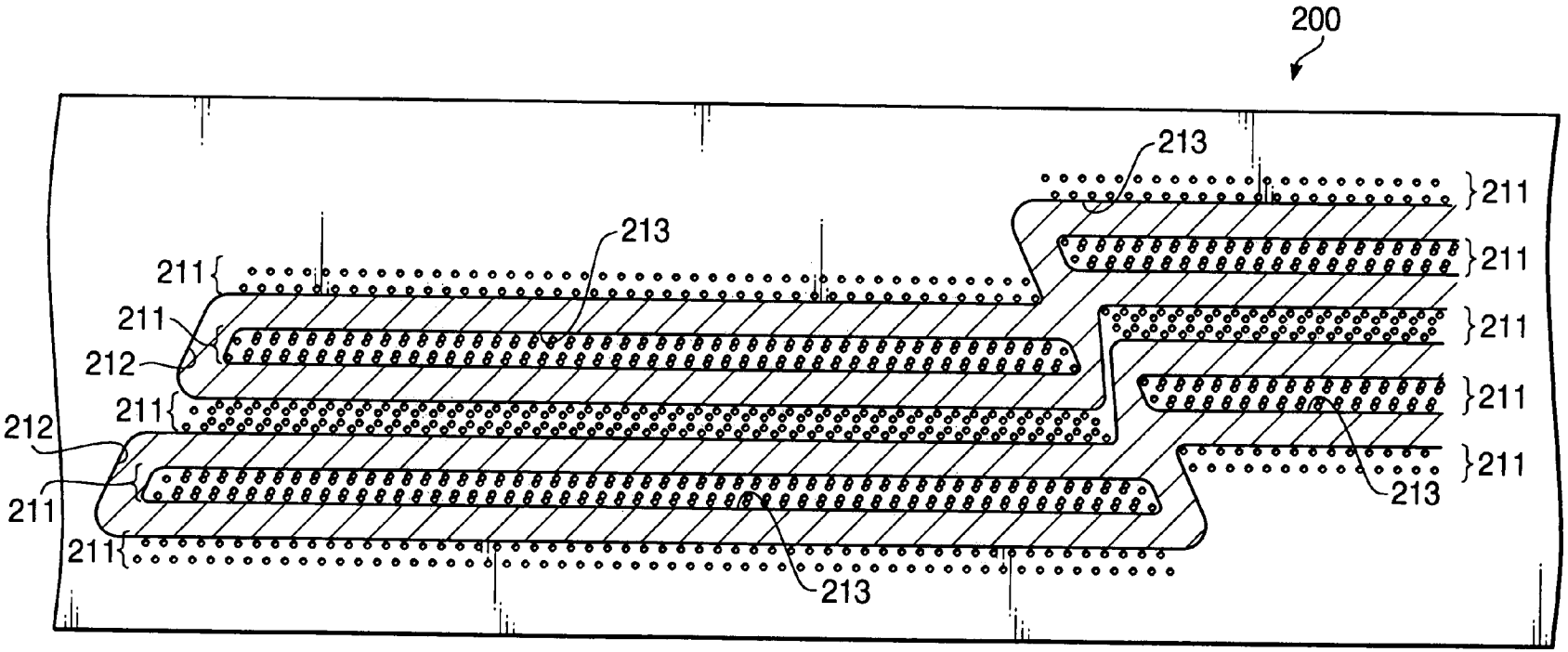
FIG. 6 shows a part of an under surface of the cover plate shown in FIG. 5.

FIG. 6 shows a part of the under surface of the cover plate 200. The under surface of the cover plate 200 is provided with two grooves 212. Each groove 212 is formed lengthwise in the longitudinal direction of the cover plate 200. A plurality of land portions 213 are defined within each groove 212, each of which also extends in the longitudinal direction of the cover plate 200. The through holes 211 are formed outside the grooves 212, along the peripheries thereof, and also within each land portion 213.

Figure 7:
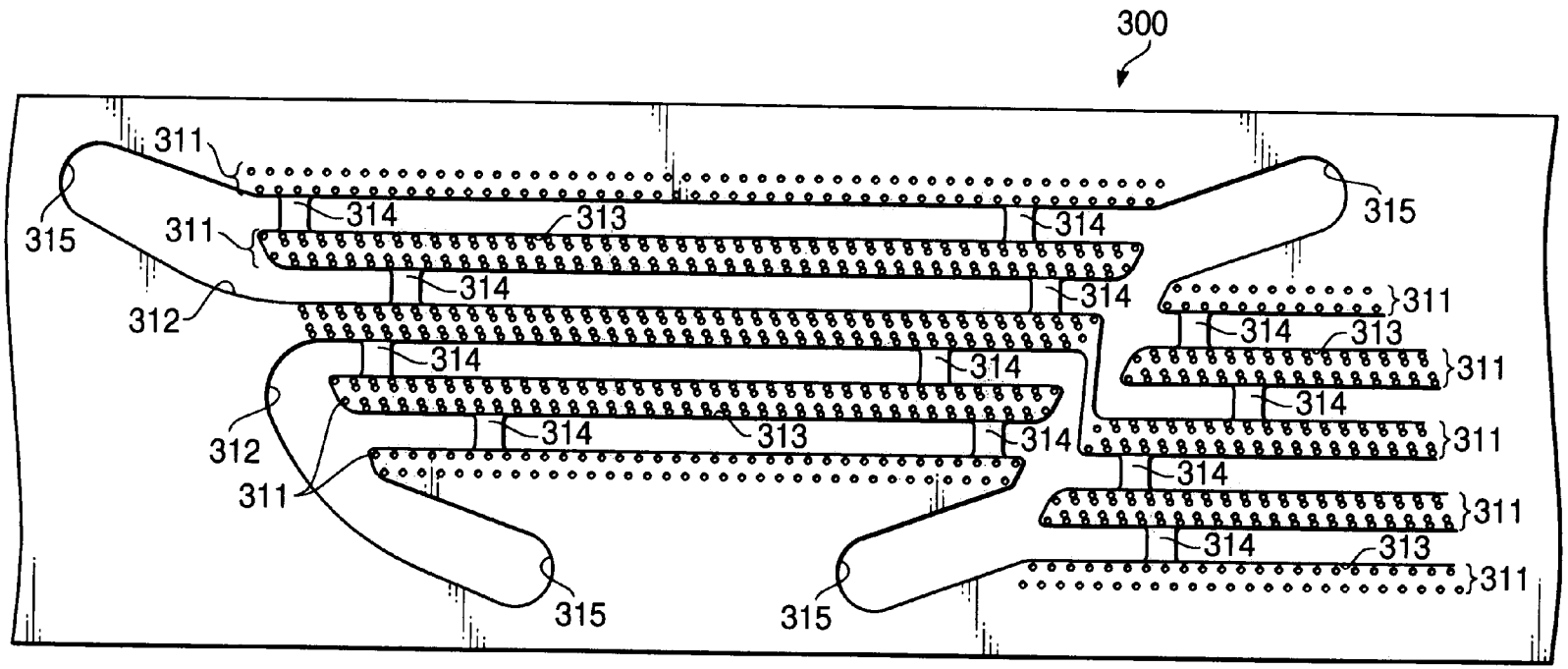
FIGS. 7, 8 and 9 are plane views of parts of first, second and third manifold plates of the inkjet head shown in FIG. 2.

FIG. 7 shows a plane view of a part of the first manifold plate 300. The first manifold plate 300 is formed with a plurality of through holes 311, which serve as ink channels. The through holes 311 of the first manifold plate 300 are formed at positions corresponding to respective ones of the through holes 211 of the cover plate 200. Thus, the through holes 311 of the first manifold plate 300 establish fluid communication with the through holes 211 of the cover plate 200 when the first manifold plate 300 is laid on top of the cover plated 200 (see FIG. 28).

Further, the first manifold plate 300 is provided with two openings 312 formed through the first manifold plate 300 in the longitudinal direction. The openings 312 constitute a part of a pair of manifold channels 20 which will be describe latter (see FIG. 28). Each opening 312 includes a plurality of elongated land portions 313. The land portions 313 are supported by a plurality of connection beams 314, which are formed by half-etching from the underside of the first manifold plate 300. The thickness of each connection beam 314 is about one half of that of the first manifold plate 300.

Note that the through holes 311 are formed along the outer peripheries of the openings 312 and on the land portions 313. It should be also noted that a plurality of ink supply portions 315 are formed so as to extend from each of the openings 312.

Figure 8:
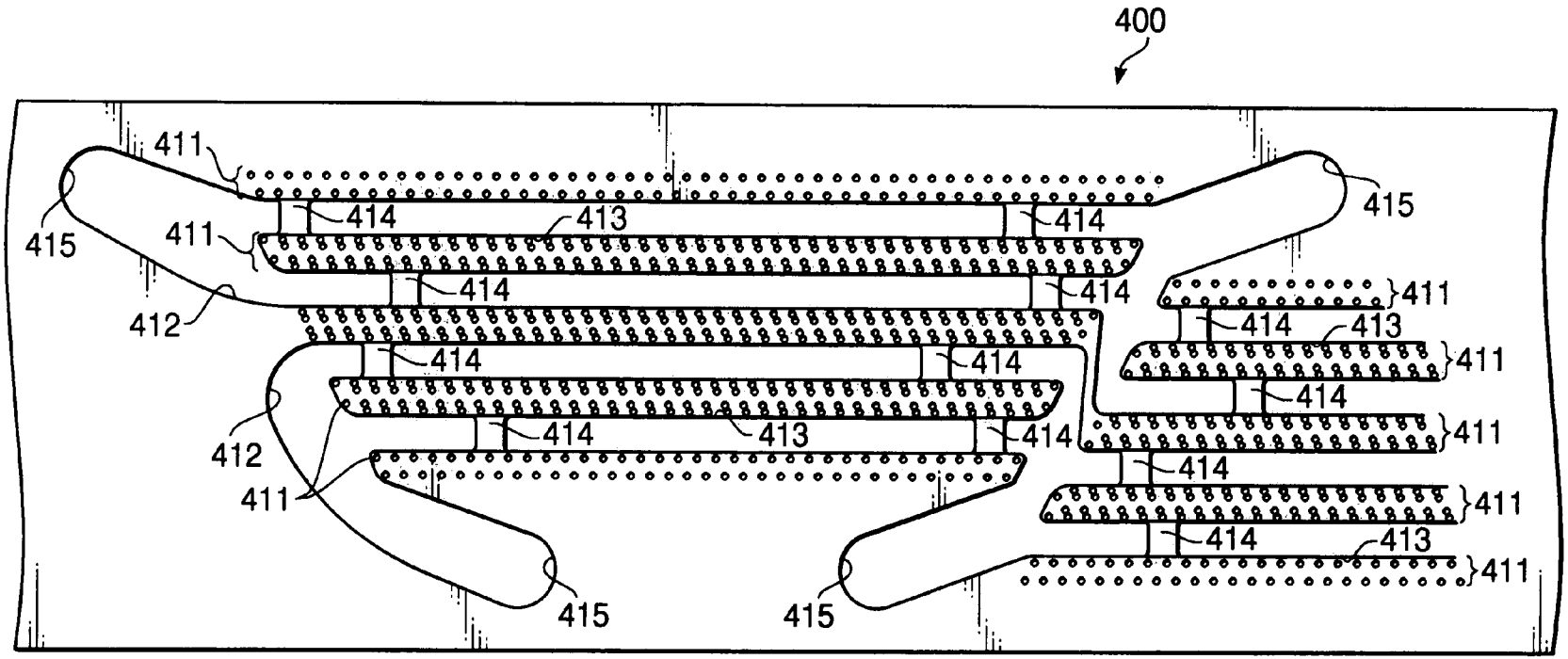

FIG. 8 is a plane view of a part of the second manifold plate 400. The second manifold plate 400 is formed with a plurality of through holes 411, which serve as ink channels. The through holes 411 of the second manifold plate 400 are formed at positions corresponding to respective ones of the through holes 311 of the first manifold plate 300. Thus, the through holes 411 of the second manifold plate 400 establish fluid communication with the through holes 311 of the first manifold plate 300 when the second manifold plate 400 is laid on top of the first manifold plate 300 (see FIG. 28).

Further, the second manifold plate 400 is provided with two openings 412 formed through the second manifold plate 400 in the longitudinal direction. The openings 412 constitute a part of the manifold channels 20 (see FIG. 28). The openings 412 of the second manifold plate 400 are formed at positions corresponding to the respective openings 312 of the first manifold plate 300. Thus, the openings 412 of the second manifold plate 400 establish fluid communication with the openings 312 of the first manifold plate 300 when the second manifold plate 400 is laid on top of the first manifold plate 300 (see FIG. 28).

Each opening 412 includes a plurality of elongated land portions 413. The land portions 313 are supported by a plurality of connection beams 414, which are formed by half-etching from the upper side of the second manifold plate 400. The thickness of each connection beam 414 is about one half of that of the second manifold plate 400.

Note that the through holes 411 are formed along the outer peripheries of the openings 412 and on the land portions 413.

It should be also noted that a plurality of ink supply portions 415 are formed so as to extend from the openings 412 at positions corresponding to respective ones of the ink supply portions 315 of the first manifold plate 300. Thus, when the second manifold plate 400 is laid on top of the first manifold plate 300, the ink supply portions 415 of the second manifold plate 400 are brought into fluid communication with the ink supply portions 415 of the second manifold plate 400 (see FIG. 28).

Figure 9:
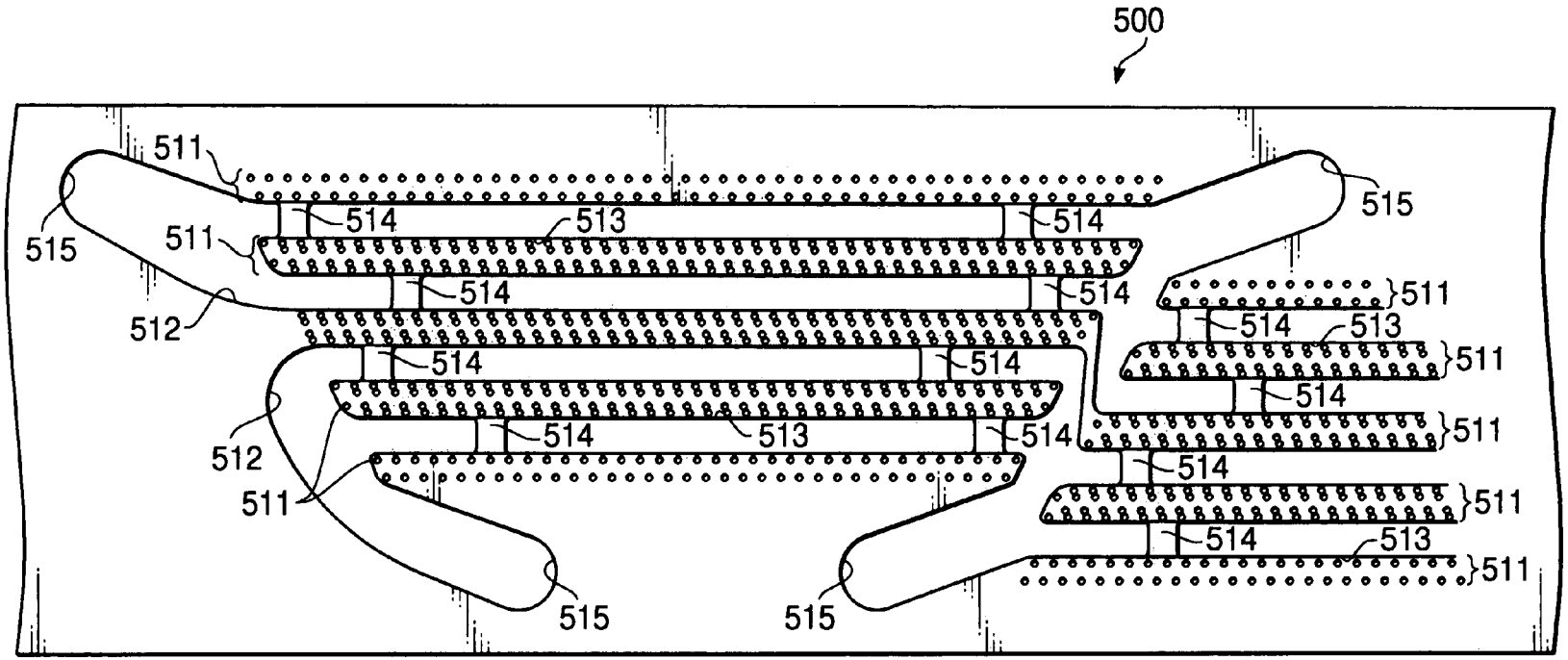

FIG. 9 is a plane view of a part of the third manifold plate 500. The third manifold plate 500 is formed with a plurality of through holes 511, which serve as ink channels. The through holes 511 of the third manifold plate 500 are formed at positions corresponding to respective ones of the through holes 411 of the second manifold plate 400. Thus, the through holes 511 of the third manifold plate 500 is brought into fluid communication with the through holes 411 of the second manifold plate 400 when the third manifold plate 500 is laid on top of the second manifold plate 400 (see FIG. 28).

Further, the third manifold plate 500 is provided with two openings 512 formed through the third manifold plate 500 in the longitudinal direction. The openings 512 constitute a part of the manifold channels 20 (see FIG. 28). The openings 512 of the third manifold plate 500 are formed at positions corresponding to the respective openings 412 of the second manifold plate 400. Thus, the openings 512 of the third manifold plate 500 establish fluid communication with the openings 412 of the second manifold plate 400 when the third manifold plate 500 is laid on top of the second manifold plate 400 (see FIG. 28).

Each opening 512 includes a plurality of elongated land portions 513. The land portions 513 are supported by a plurality of connection beams 514, which are formed by half-etching from the upper side of the third manifold plate 500. The thickness of each connection beam 514 is about one half of that of the third manifold plate 500.

Note that the through holes 511 are formed along the outer peripheries of the openings 512 and on the land portions 513.

It should be also noted that a plurality of ink supply portions 515 are formed so as to extend from the openings 512 at positions corresponding to respective ones of the ink supply portions 415 of the second manifold plate 400. Thus, when the third manifold plate 500 are laid on top of the second manifold plate 400, the ink supply portions 515 of the third manifold plate 500 is brought into fluid communication with the ink supply portions 415 of the second manifold plate 400 (see FIG. 28).

Figure 10:
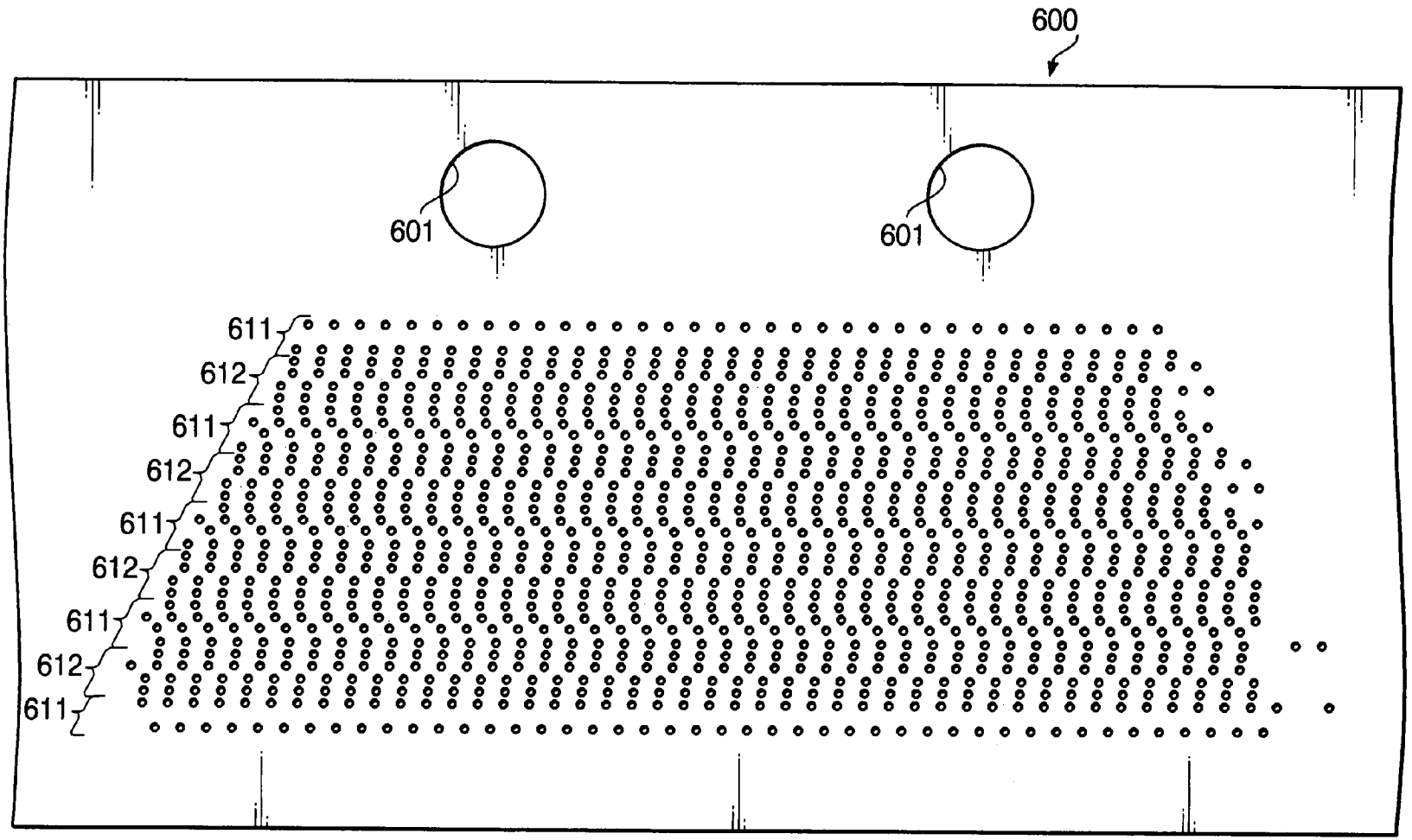
FIG. 10 is a plane view of a part of a supply plate of the inkjet head shown in FIG. 2.

Referring back to FIG. 3, a plurality of substantially trapezoidal areas 610 are defined on the supply plate 600. As shown in FIG. 10, each trapezoidal area 610 is provided with a plurality of fine diameter through holes 611, which serve as ink channels, and a plurality of filter portions 612, which also serve as ink channels.

The through holes 611 are formed at positions corresponding to the through holes 511 of the third manifold plate 500. Thus, the through holes 611 of the supply plate 600 establish fluid communication with the through holes 511 of the third manifold plate 500 when the supply plate 600 is laid on top of the third manifold plate 500 (see FIG. 28).

Figure 28:
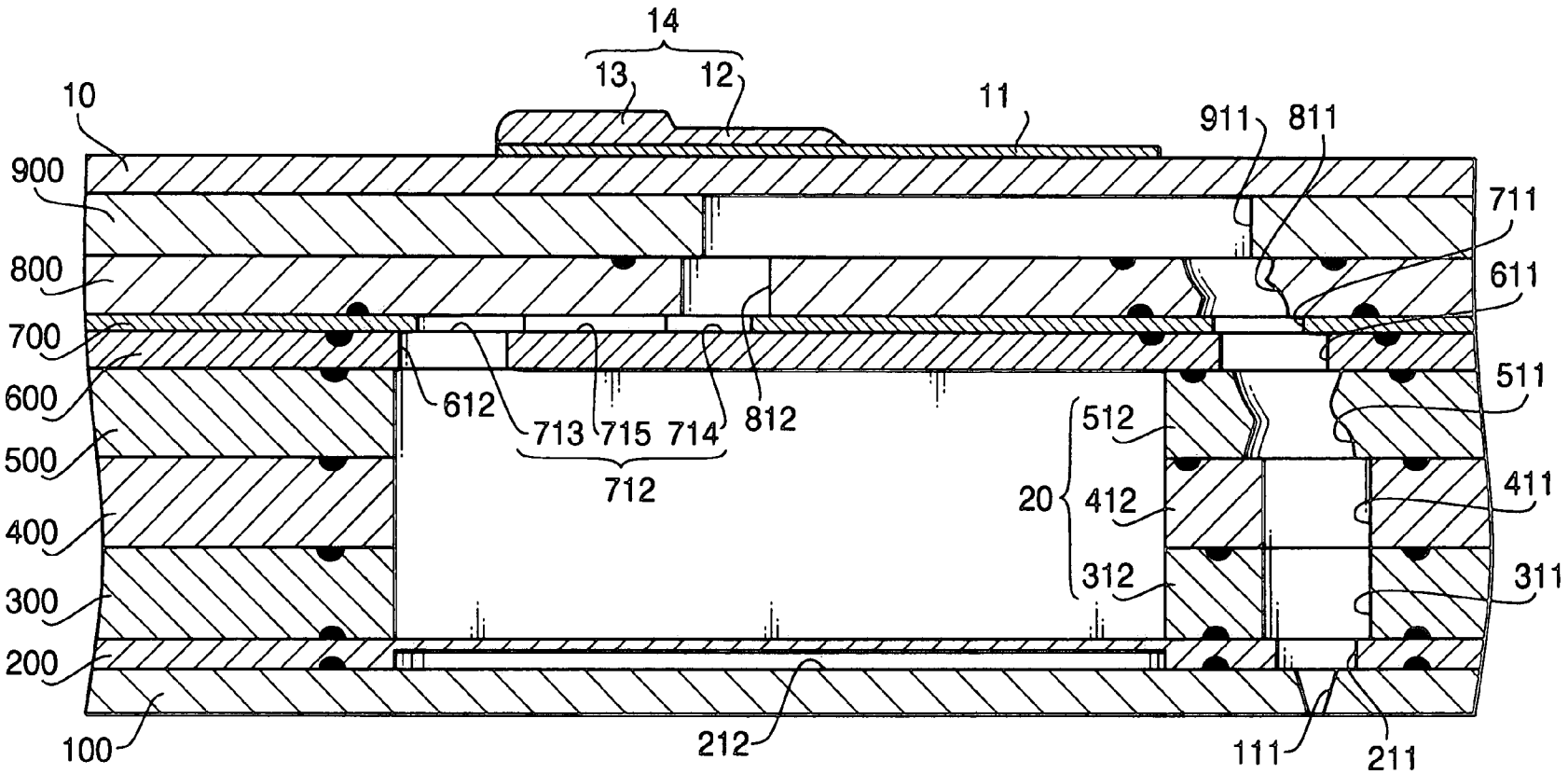
FIG. 28 is a sectional view of a part of the inkjet head showing apart of an ink channel extending from one of the nozzles.

The filter portions 612 of the supply plate 600 are formed so as to be brought into fluid communication with either of the two openings 512 when the supply plate 600 is laid on top of the third manifold plate 500 (see FIG. 28).

Figure 11:
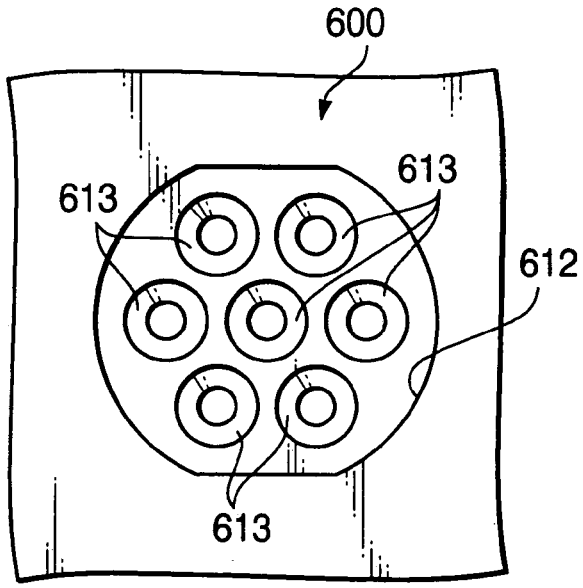
FIG. 11 shows a top view of a filter portion of the supply plate shown in FIG. 10.
Figure 12:
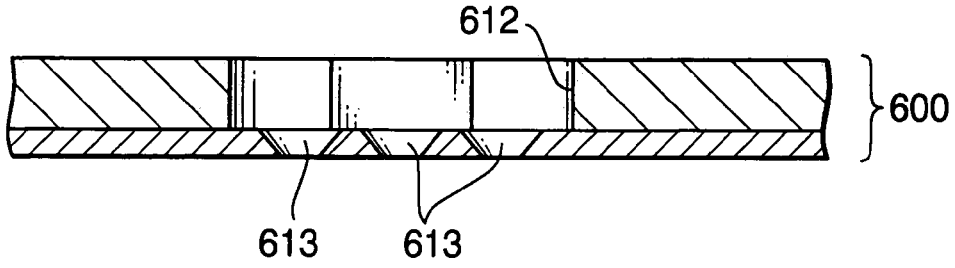
FIG. 12 shows a sectional view of a part of the supply plate including the filter portion shown in FIG. 1.

FIG. 11 shows a top view of a filter portion 612 of the supply plate 600, and FIG. 12 shows a sectional view of a portion of the supply plate 600 including one of the filter portions 612. As shown in FIGS. 11 and 12, the filter portions 612 is a recess formed on the supply plate 600, which recess is provided with a plurality of filter holes 613 formed trough the bottom thereof. The filter holes 613 remove foreign matter from the ink passing through the filter portion 612.

Referring back to FIGS. 3 and 10, the supply plate 600 is further provided with ten small size ink supply openings 601 formed through the supply plate 600 at positions outside the substantially trapezoidal areas 610. The ink supply openings 601 are formed so as to face and thereby establish fluid communication with respective ones of the ink supply portions 515 of the third manifold plate 500 when the supply plate 600 is laid on top of the third manifold plate 500.

Figure 13:
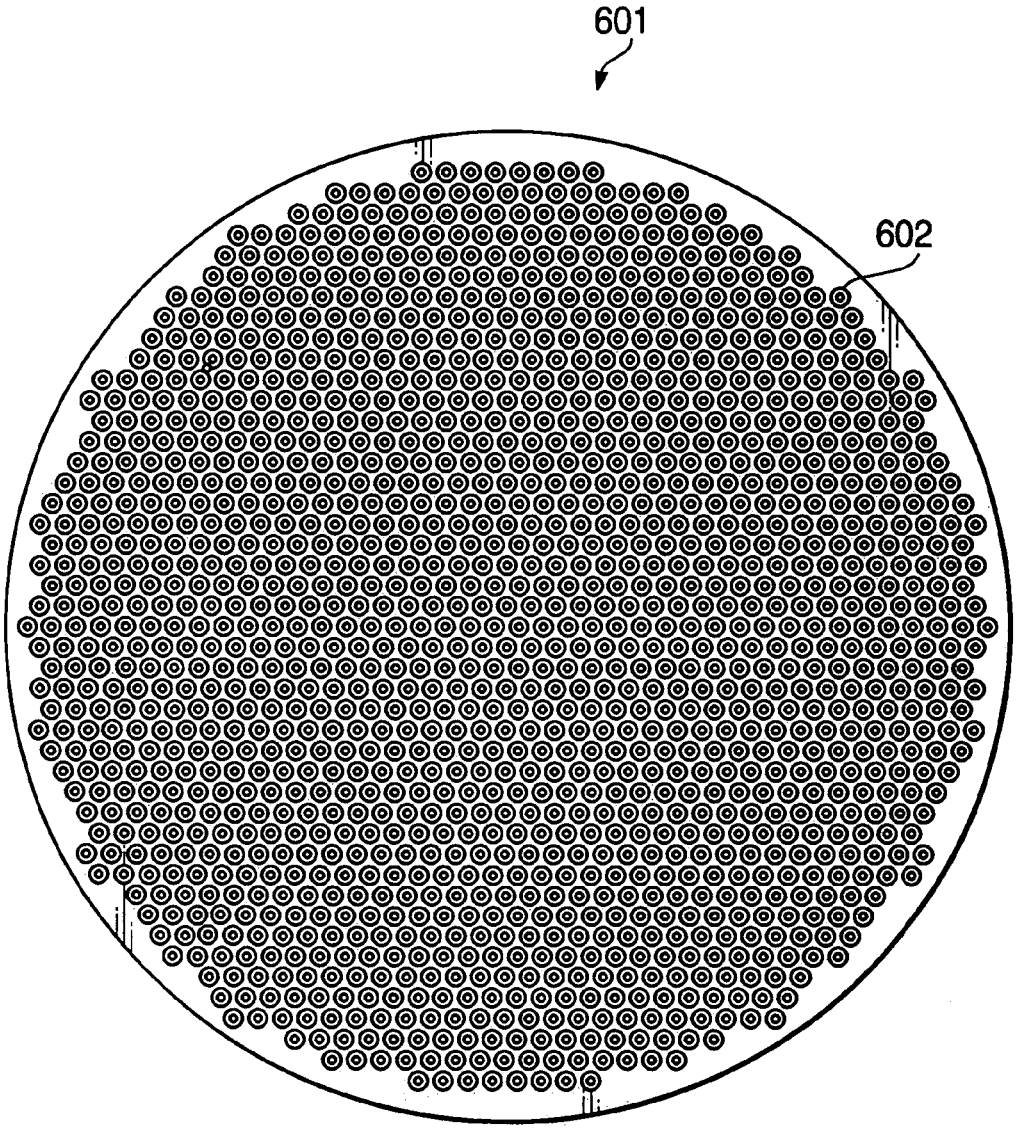
FIG. 13 is a top view of an ink supply opening of the supply plate of the inkjet head shown in FIG. 2.

FIG. 13 is a top view of the ink supply opening 601. As shown in FIG. 13, the ink supply opening 601 is formed with a plurality of filter holes 602 that prevent foreign matter (e.g., dust) within the ink from being introduced into the manifold channels 20.

Figure 14:
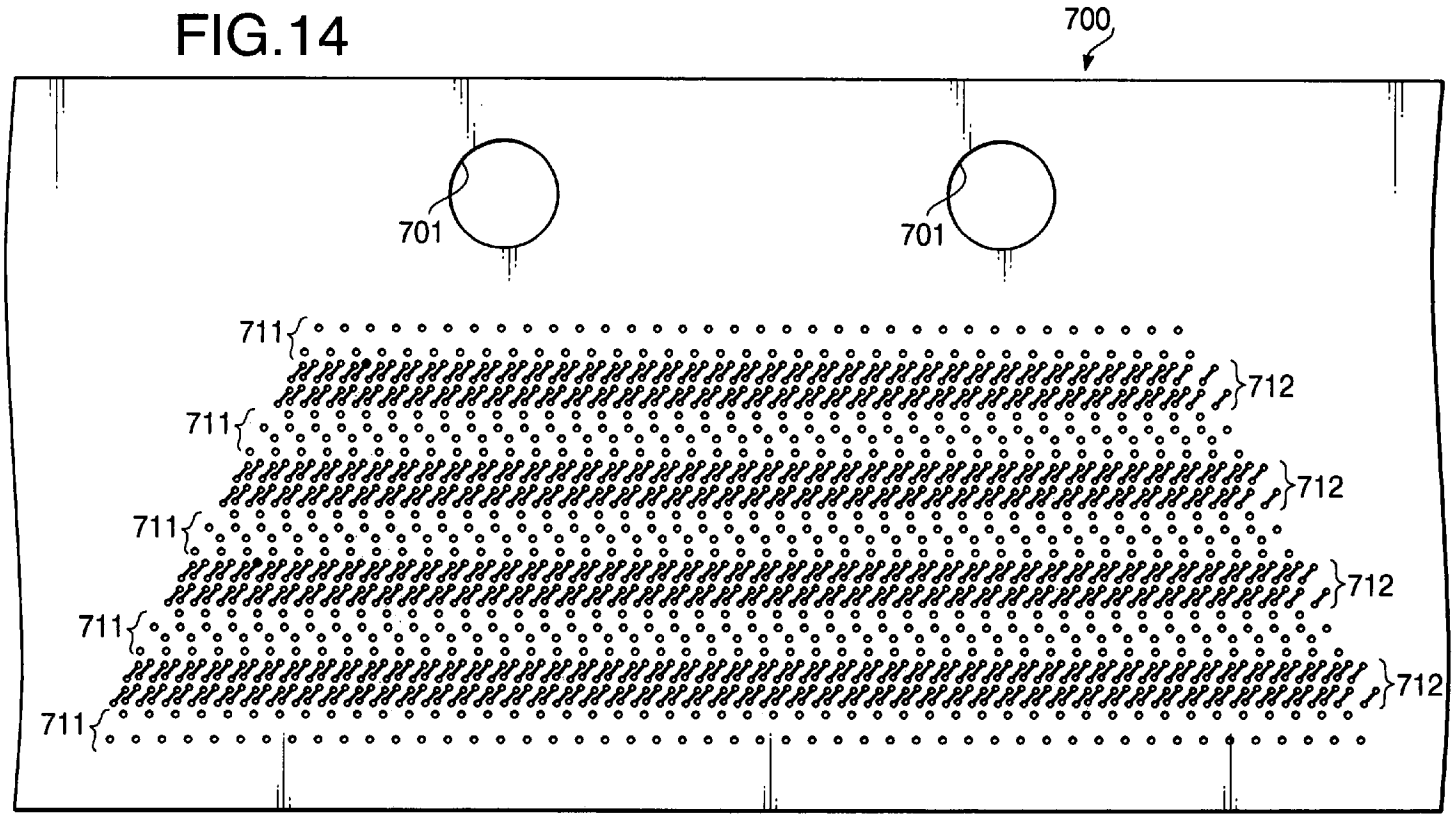
FIG. 14 shows a top view of a part of an aperture plate of the inkjet head shown in FIG. 2.

Referring back to FIG. 3, the aperture plate 700 has four substantially trapezoidal areas 710 defined thereon. As shown in FIG. 14, which shows a top view of a part of the aperture plate 700, each trapezoidal area 710 is provided with a plurality of fine diameter through holes 711 and a plurality of restriction portions 712. The through holes 711 are formed so as to face and thereby establish fluid communication with the respective through holes 611 of the supply plate 600 when the aperture plate 700 is laid on top of the supply plate 600 (see FIG. 28).

Figure 15:
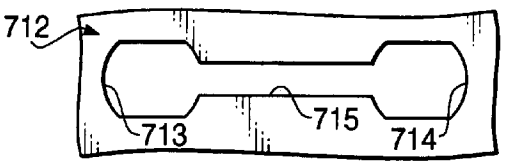
FIG. 15 is a top view of a restriction portion of the aperture plate shown in FIG. 14.

FIG. 15 is a top view of the restriction portion 712. The restriction portion 712 is a through hole formed in the aperture plate 700 by press work. The restriction portion 712 has an inlet portion 713, an outlet portion 714, and a channel portion 715 extending between the inlet and outlet portions 713 and 714 to bring them in fluid communication with each other.

The restriction portions 712 are located so that the inlet portions 713 generally face and thereby establish fluid communication with respective filter portions 612 of the supply plate 600 as the aperture plate 700 is laid on the top of the supply plate 600 (see FIG. 28).

Referring back to FIG. 3 and 14, the aperture plate 700 is further provided with ten small size ink supply openings 701 formed therethrough at positions outside the four substantially trapezoidal areas 710. The ink supply openings 701 are formed so as to face and thereby establish fluid communication with respective ink supply openings 601 of the supply plate 600 as the aperture plate 700 is laid on top of the supply plate 600 (see FIG. 28).

Figure 16:
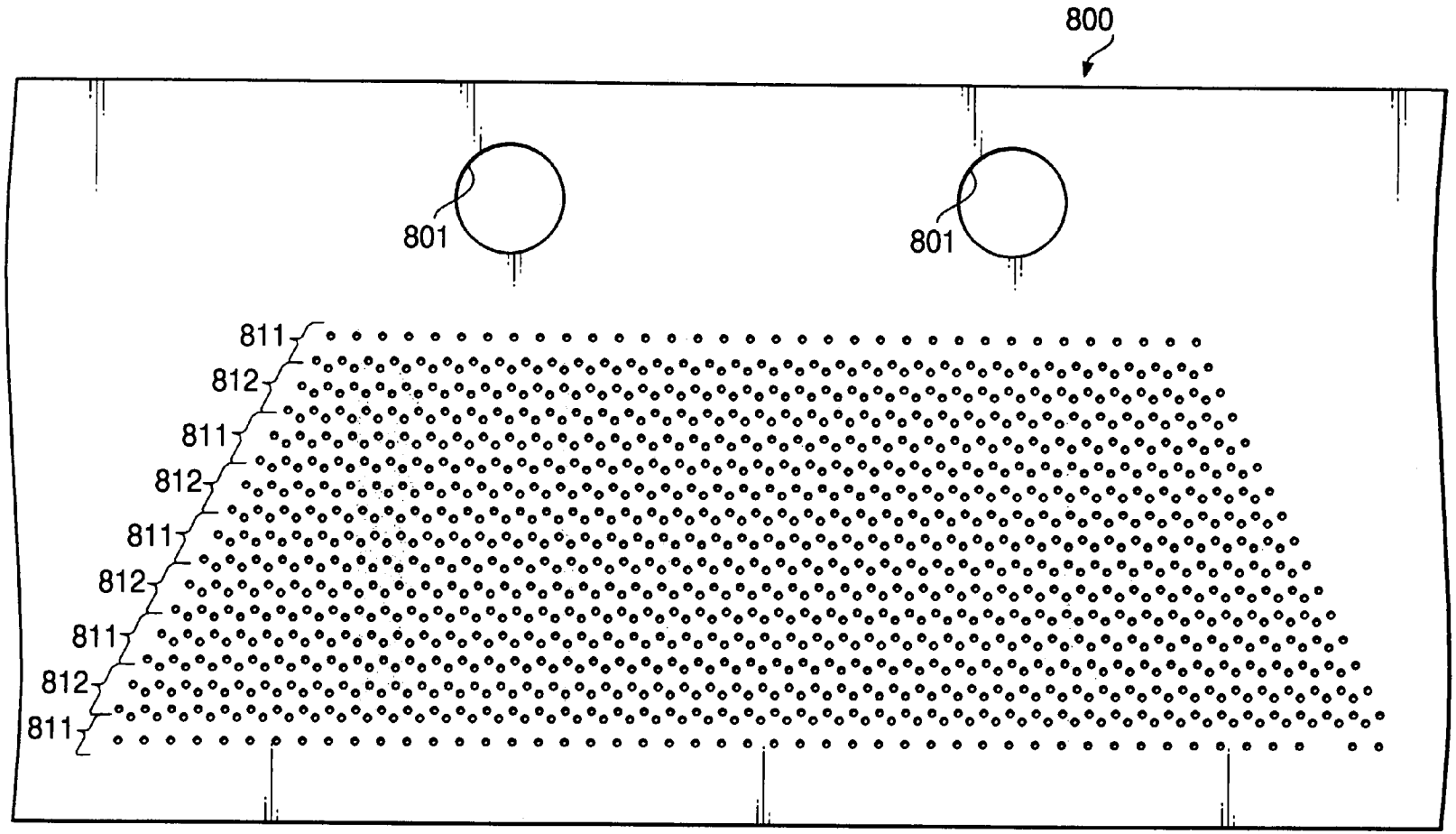
FIG. 16 shows a top view of a part of a base plate of the inkjet head shown in FIG. 2.

Referring back to FIG. 3, the base plate 800 has four substantially trapezoidal areas 810 defined thereon. As shown in FIG. 16, which shows a top view of a part of the base plate 800, each trapezoidal area 810 is provided with a plurality of fine diameter through holes 811 and a plurality of fine diameter through holes 812, both of which serve as ink channels. The through holes 811 are formed so as to face and thereby establish fluid communication with the through holes 711 of the aperture plate 700 when the base plate 800 is laid on top of the aperture plate 700 (see FIG. 28). The through holes 812 are formed so as to generally face and thereby establish fluid communication with the restriction portions 712 of the aperture plate 700 when the base plate 800 is laid on top of the aperture plate 700 (see FIG. 28).

The base plate 800 is further provided with ten small size ink supply opening 801 formed therethrough at positions outside the four substantially trapezoidal areas 810. The ink supply openings 801 are formed so as to face and thereby establish fluid communication with the ink supply openings 701 of the aperture plate 700 as the base plate 800 is laid on top of the aperture plate 700 (see FIG. 28).

Figure 17:
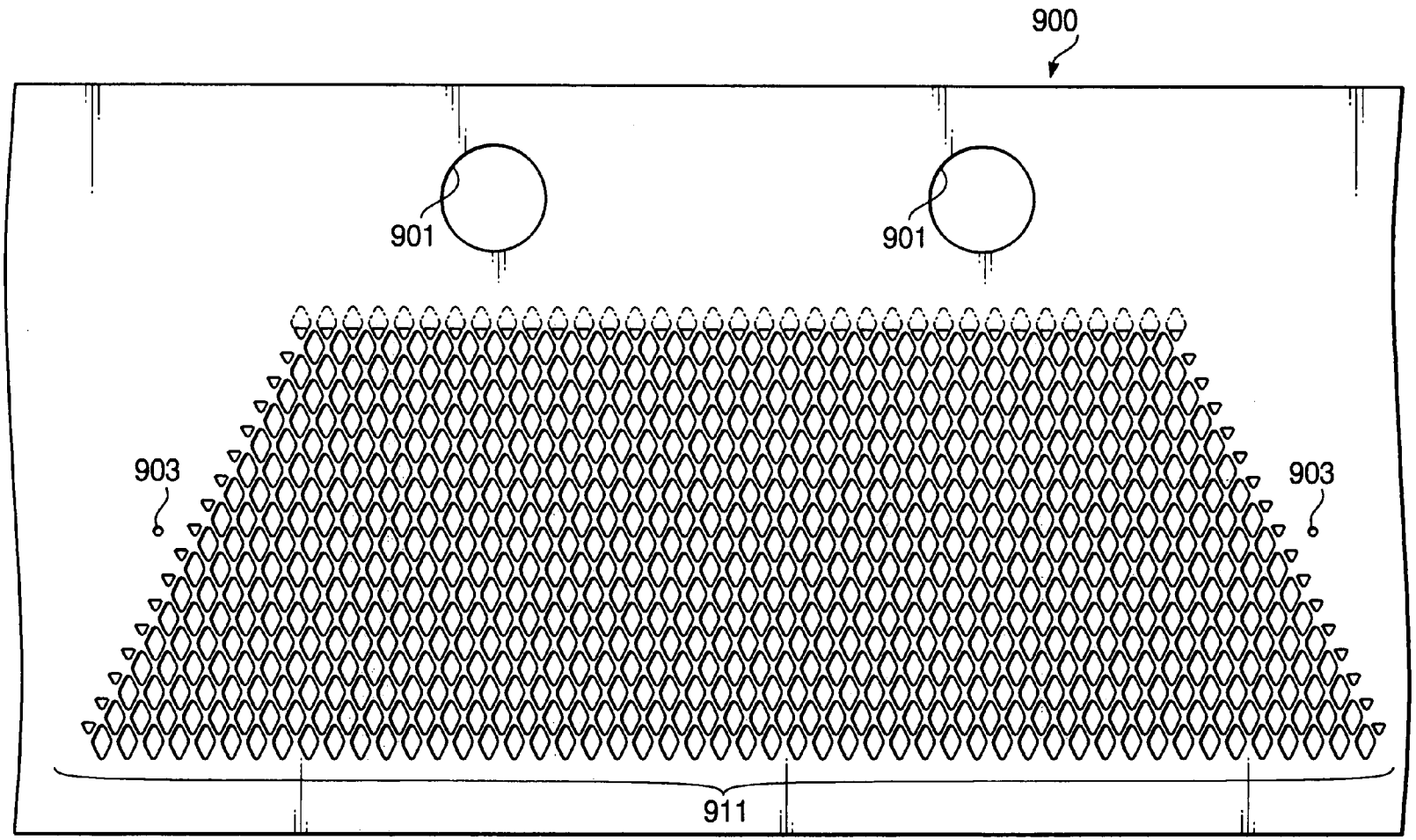
FIG. 17 shows a top view of a part of a cavity plate of the inkjet head shown in FIG. 2.

Referring back to FIG. 3, the cavity plate 900 also has four substantially trapezoidal areas 910 defined thereon. As shown in FIG. 17, which shows a top view of a part of the cavity plate 900, the cavity plate 900 is provided with a matrix of a plurality of substantially rhombus openings, or ink chambers 911, that are formed through the cavity plate 900 at density corresponding to the printing resolution required for the inkjet head 1.

Each ink chamber 911 has a pair of acute angle corners and a pair of obtuse angle corners. The ink chambers 911 are arranged such that the acute angle corners of each ink chamber 911 are placed between acute angle corners of adjacent ink chambers 911, so that the ink chambers can be arranged at high density.

The ink chambers 911 are arranged such that one of the acute angle corners of each ink chamber 911 faces and establishes fluid communication with one of the through holes 811 of the base plate 800, while the other one of the acute angle corners faces and establishes fluid communication with one of the through holes 812 of the base plate 800, when the cavity plate 900 is laid on top of the base plate 800 (see FIG. 28).

The cavity plate 900 is also provided with ten small size ink supply openings 901 which are formed at positions outside the substantially trapezoidal area 910. The ink supply openings 901 are formed so as to face and establish fluid communication with respective ink supply openings 801 of the base plate 800 as the cavity plate 900 is laid on top of the base plate 800 (FIG. 28).

It should be also noted that positioning holes 903 are formed in a vicinity of each oblique side of each areas 910. These positioning holes assist in positioning of the piezoelectric sheets 10 on the cavity plate 900.

Next, the general structure of the piezoelectric sheet 10 and the FPC board 50 as well as the electrical connection therebetween will be described.

Figure 18:
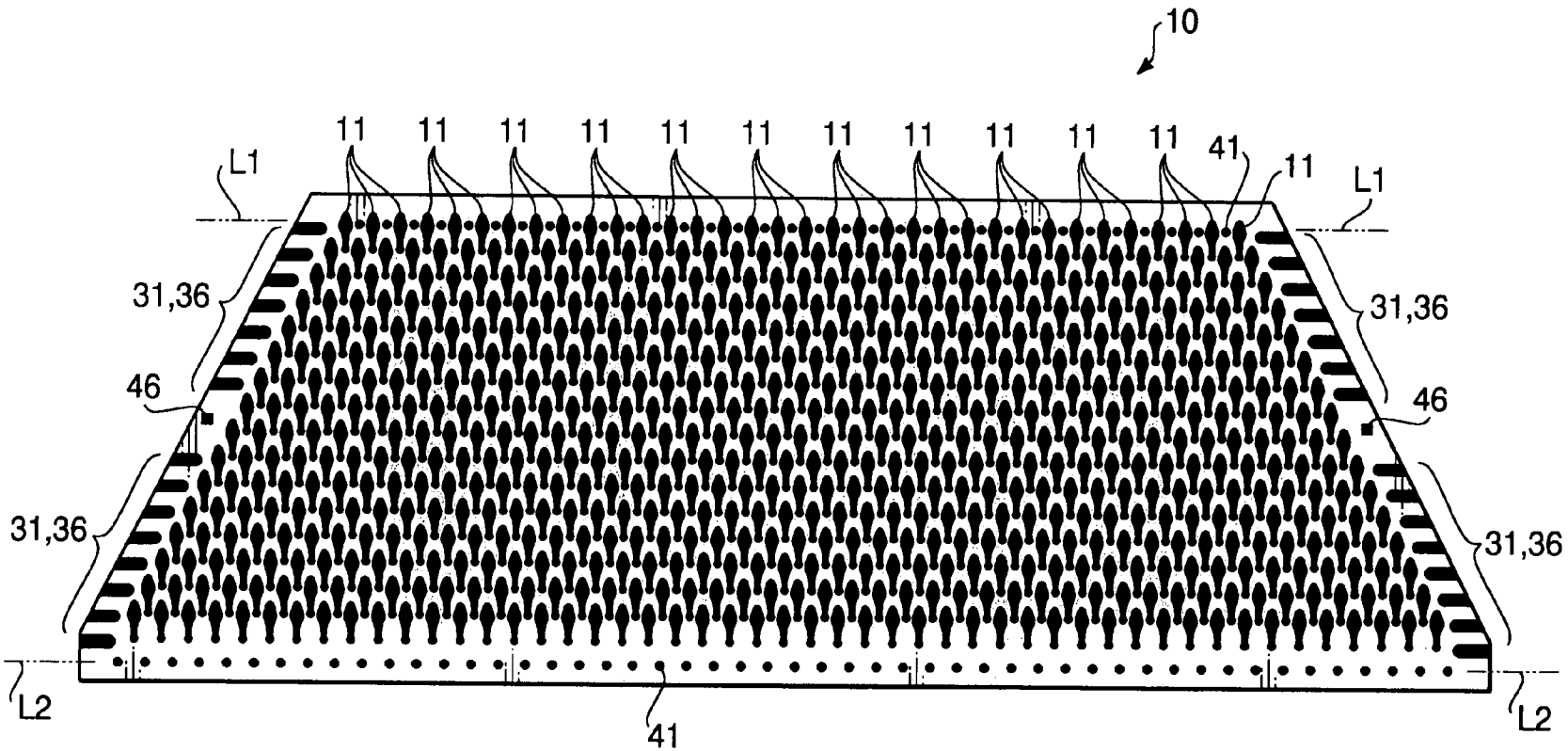
FIG. 18 shows a top view of a piezoelectric sheet of the inkjet head 2.

First, the general structure of the piezoelectric sheet 10 will be described. FIG. 18 shows a top view of the piezoelectric sheet 10. The piezoelectric sheet 10 is provided with a plurality of substantially rhombus driving electrodes 11 that are arranged on the piezoelectric sheet in matrix at density corresponding to the printing resolution required for the inkjet head 1. The driving electrodes 11 are formed at positions corresponding to respective ones of the ink chambers 911 of the cavity plate 900. Thus, the driving electrodes 11 are located above respective ink chambers 911 when the piezoelectric sheet 10 is laid on top of the cavity plate 900 to close the upper side of each ink chamber 911.

Figure 19:
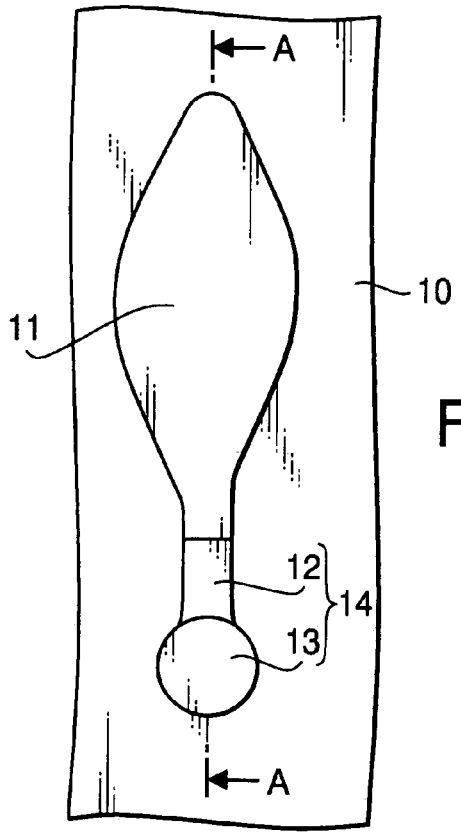
FIG. 19 shows a top view of a driving electrode formed on the piezoelectric sheet shown in FIG. 18.
Figure 20:
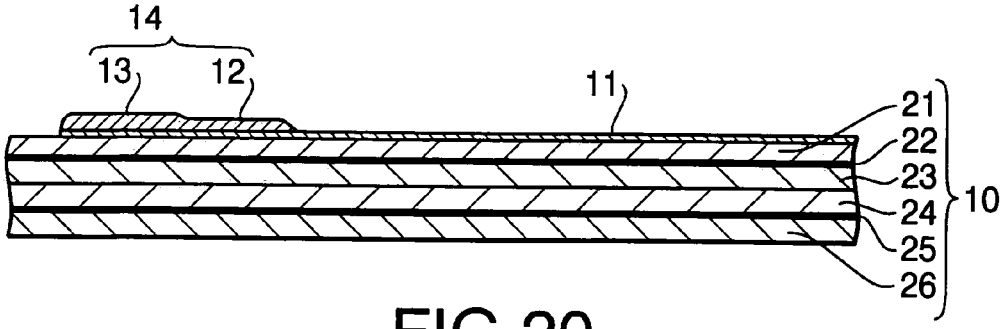
FIG. 20 shows a sectional view of a part of the piezoelectric sheet taken along a line A—A of FIG. 19.

FIG. 19 shows a top view of the driving electrode 11, and FIG. 20 shows a sectional view of a part of the piezoelectric sheet 10 taken along the line A—A in FIG. 19.

As shown in FIG. 19, the substantially rhombus driving electrode 11 is provided with rounded corners. However, this is not essential for the shape of the driving electrode 11 and the driving electrode 11 may be also provided with sharp corners. A contact land 14 extends from one of the acute angle corners of the driving electrode 11 so as to be located in a vicinity of the driving electrode 11. The contact land portion 14 is formed in two-tier structure having a first level portion 12, formed higher than the driving electrode 11, and a second level portion 13 higher than the first level portion 12. The first level portion 12 is formed between the second level portion 13 and the driving electrode 11. It should be noted that the second level portion 13 is to be connected to the FPC board 50 by means of solder for power supply. The contact land portion 14 is formed so as to be located outside an area defined as directly above the corresponding ink chamber 911, as will be described later in connection with FIGS. 28 and 30, and such that the second level portion 13 is sufficiently spaced apart from the driving electrode 11 for preventing the solder from flowing up to the driving electrode 11 at the time of connecting the second level portion 13 to the FPC board 50.

As shown in FIG. 20, the piezoelectric sheet 10 has a laminated structure in which a first piezoelectric layer 21, second piezoelectric layer 23, third piezoelectric layer 24, and a fourth piezoelectric layer 26 are laminated. An inner electrode 22 is formed between the first piezoelectric layer 21 and the second piezoelectric layer 23, and an inner electrode 25 is formed between the third piezoelectric layer 24 and the fourth piezoelectric layer 26. The ends of the inner electrodes 22 and 25 are exposed on the oblique side surfaces of the piezoelectric sheet 10. Note that the various piezoelectric sheets 10 are attached on the cavity plate 900 so as to make contact with each other at the oblique side surfaces thereof. Thus, the inner electrodes 22 and 25 of the various piezoelectric sheets 10 are electrically connected to each other.

Referring back to FIG. 18, a plurality of first common electrodes 31 and a plurality of second common electrodes 36 are alternately formed on the top face of each piezoelectric sheet 10 along the oblique side thereof.

Figure 21:
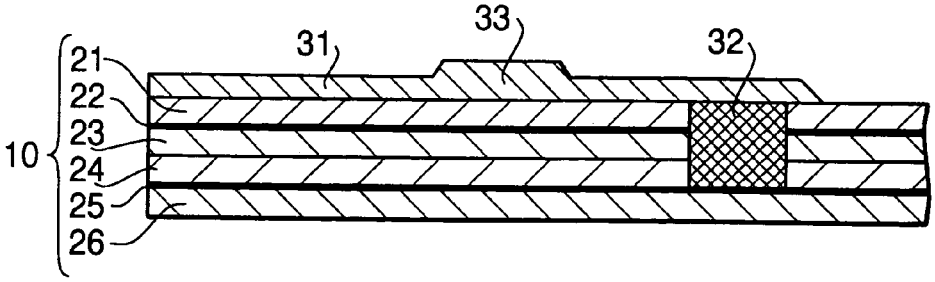
FIG. 21 shows a sectional view of the piezoelectric sheet at a portion thereof including a first common electrode.

FIG. 21 shows a sectional view of the piezoelectric sheet 10 at a portion thereof including one of the first common electrodes 31. As shown in FIG. 21, the first common electrode 31 is electrically connected with the inner electrode 25 formed between the third piezoelectric layer 24 and the fourth piezoelectric layer 26 via a through hole 32. Further, the first common electrode 31 is provided with a protrusion 33, which serves as a contact land.

Figure 22:
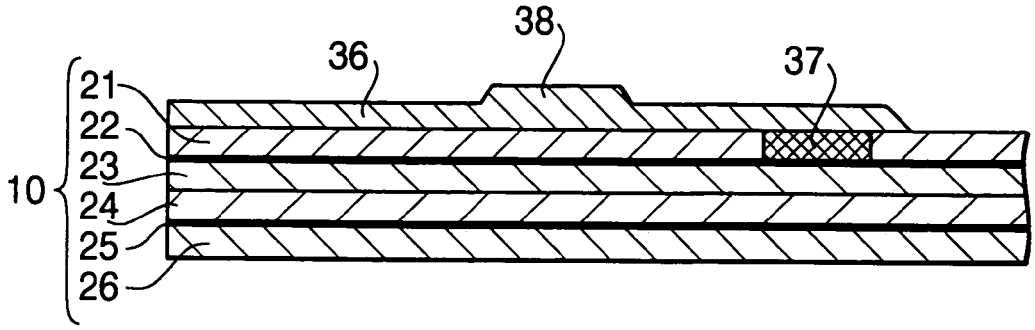
FIG. 22 shows a sectional view of the piezoelectric sheet at a portion thereof including a second common electrode.

FIG. 22 shows a sectional view of the piezoelectric sheet 10 at a portion thereof including one of the second common electrodes 36. As shown in FIG. 22, the second common electrode 36 is electrically connected with the inner electrode 22 formed between the first piezoelectric layer 21 and the second piezoelectric layer 23 via a through hole 37. Further, the second common electrode 36 is provided with a protrusion 38, which serves as a contact land.

Referring back to FIG. 18, each piezoelectric sheet 10 is provided with positioning marks 46 formed on the top face thereof in a vicinity of each oblique side. Further, each piezoelectric sheet 10 is provided with a plurality of circular dummy electrodes 41 formed on the top face thereof. The dummy electrodes 41 are arranged in a vicinity of the upper and lower sides, or the parallel sides, of the trapezoidal piezoelectric sheet 10 along imaginary lines L1 and L2 that extend parallel to the upper and lower sides.

Figure 23:
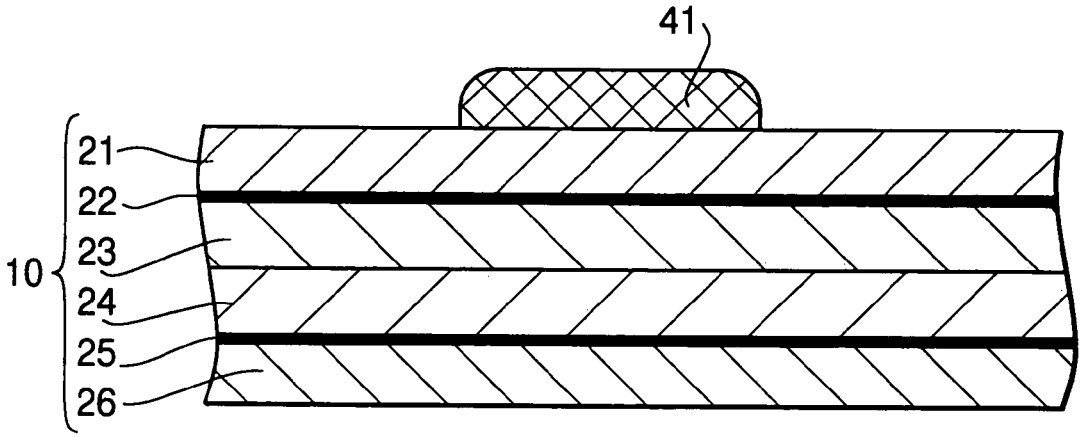
FIG. 23 is a sectional view of the piezoelectric sheet at a portion thereof including a dummy electrode.

FIG. 23 is a sectional view of the piezoelectric sheet 10 at a portion thereof including one of the dummy electrodes 41. As shown in FIG. 23, the dummy electrode 41 is not connected with either of the inner electrodes 22 or 25.

Next, the general structure of the FPC board 50 will be described.

Figure 24:
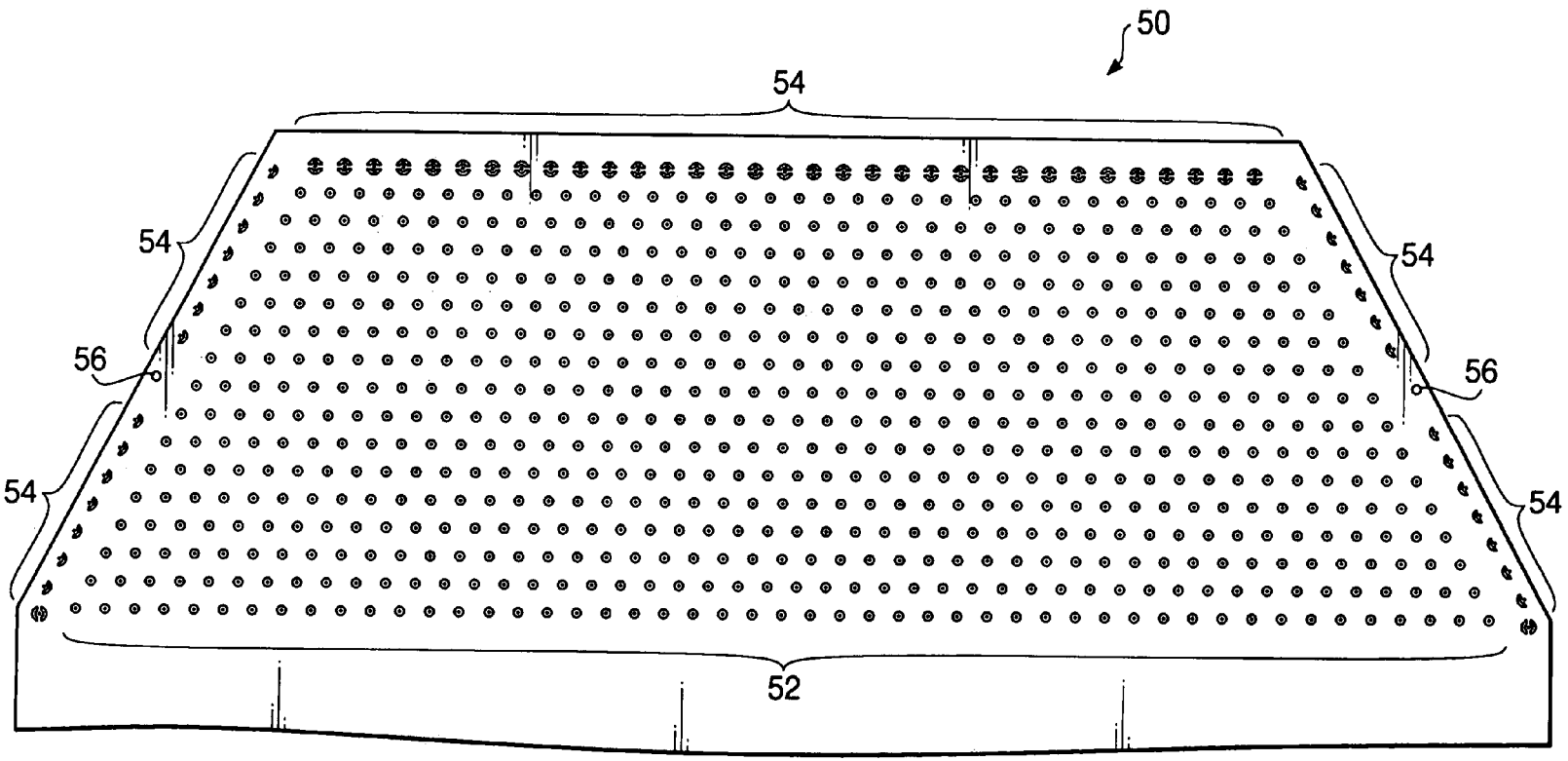
FIG. 24 is a plane view of an extended portion of a flexible printed board (FPC board) of the inkjet head shown in FIG. 2.
Figure 25:
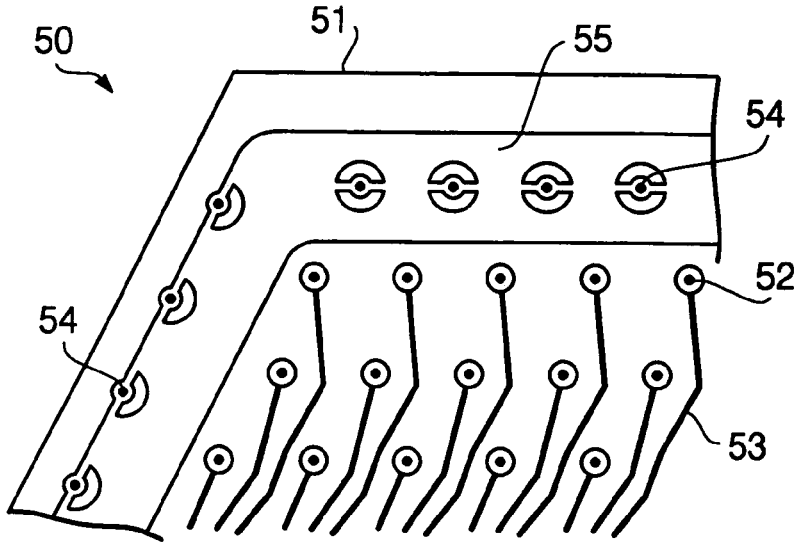
FIG. 25 is an enlarge view of a part of the extended portion of the FPC board shown in FIG. 24.

FIG. 24 is a plane view of the extended portion 51 of the FPC board 50, and FIG. 25 is an enlarged view of a part of the extended portion 51 of the FPC board 50.

As shown in FIG. 24, the FPC board 50 is provided with a plurality of contact lands 52 formed on the extended portion 51 thereof. The contact lands 52 are formed at positions corresponding to the second level portions 13 of the driving electrodes 11 of the piezoelectric sheet 10. Thus, when the FPC board 50 is attached on the piezoelectric sheet 10, the contact lands 52 come into contact with the driving electrodes 11 at the second level portions 13 thereof. Each contact land 52 is connected with a conductive pattern 53 made of copper foil, as shown in FIG. 25. Note that the conductive patterns 53 are omitted in FIG. 24 for simplicity.

As shown in FIG. 24, a plurality of contact lands 54 are formed on the extended portion 51 of the FPC board 50 along the tip end and both oblique sides thereof. The contact lands 54 arranged along the tip end of the extended portion 51 are located at positions corresponding to respective ones of the dummy electrodes 41 formed on the piezoelectric sheet 10 along the imaginary line L1 (see FIG. 18) so as to make contact therewith when the FPC board 50 is attached on the piezoelectric sheet 10. The contact lands 54 arranged along the oblique sides of the extended portion 51 of the FPC board 50 are located at positions corresponding to respective ones of common electrodes 31 and 36 formed alternately along the oblique sides of the piezoelectric sheet 10 so as to make contact therewith as the FPC board 50 is attached on the piezoelectric sheet 10.

Note that, as shown in FIG. 25, each of the contact lands 54 is electrically connected to a conductive pattern 55 made of copper foil.

Figure 26:
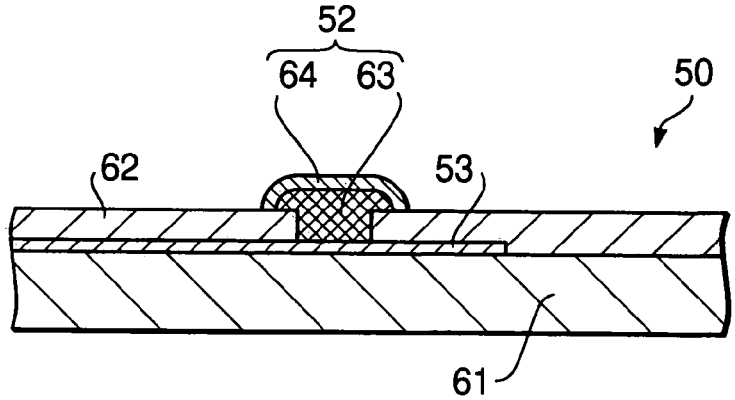
FIG. 26 shows a sectional view of the FPC board at a portion thereof including a contact land.

FIG. 26 shows a sectional view of the FPC board 50 at a portion thereof including one of the contact lands 52. The FPC board 50 includes a base film 61 such as a polyimide film, the above-mentioned conductive patterns 53 formed on the base film 61, and a cover layer 62 extending over the base film 61 and the conductive patterns 53. The cover layer is provided with a plurality of holes formed therethrough at positions above end portions of the conductive patterns 53. The holes are filled with nickel 63 formed by plating. The portion of the nickel 63 protruding from the hole is covered with solder 64. The nickel 63 and the solder 64 constitute the contact land 52 of the FPC board 50.

It should be noted that the contact lands 54 formed along the tip end and oblique sides of the extended portions 51 of the FPC board 50 and the conductive pattern 55 connected thereto have substantially the same configuration as the contact lands 52 and the conductive patterns 53.

Figure 27:
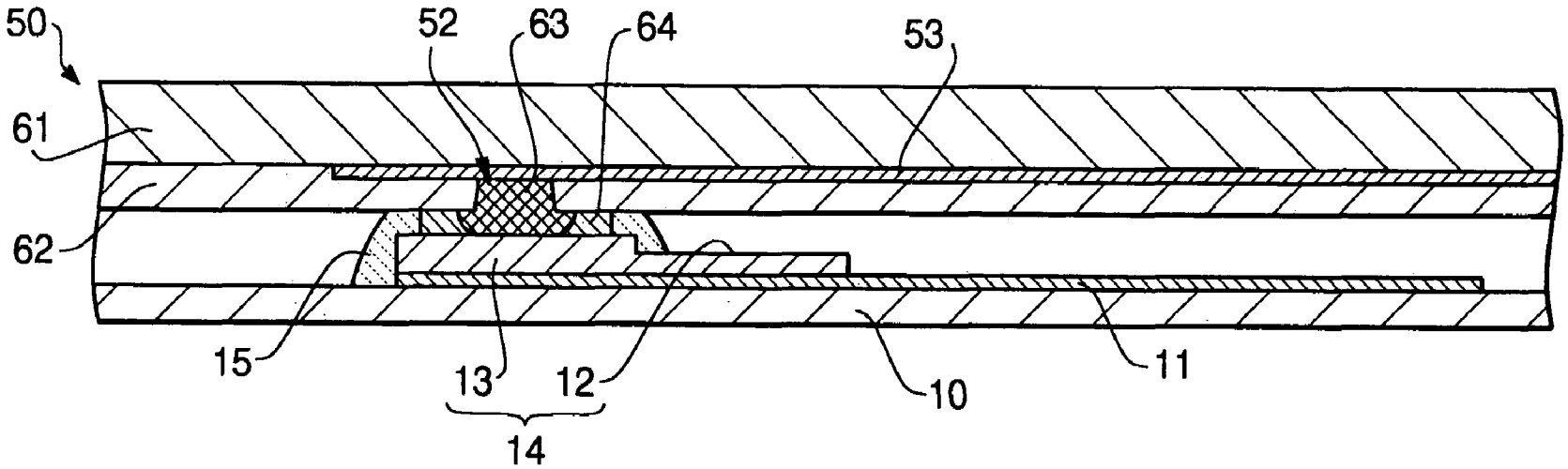
FIG. 27 a sectional view of the FPC board and the piezoelectric sheet at contact lands thereof connected to each other.

Referring back to FIG. 24, the extended portion 51 of the FPC board 50 is provided with positioning marks 56 formed in a vicinity of each oblique side thereof to assist in positioning of the extended portion 51 on the piezoelectric sheet 10. That is, if the extended portion 51 of the FPC board 50 is placed on the piezoelectric sheet 10 such that the positioning marks 56 thereon are aligned with the positioning marks 46 on the piezoelectric sheet 10, each contact land 52 of the FPC board 50 is placed on the second level portion 13, or land portion 14, of the corresponding driving electrode 11 of the piezoelectric sheet 10. Thus, each contact land 52 (or nickel portion 63 and solder portion 64) of the FPC board 50 can be fixed onto the corresponding driving electrode 11 (or the second level portion 13) of the piezoelectric sheet 10 by means of compression thermo, for example, so as to establish electrical connection therebetween, as shown in FIG. 27.

When the contact land 52 of the FPC board 50 and the land portion 14 of the driving electrode 11 of the piezoelectric sheet 10 are connected with each other as described above, the contact land 52 (the nickel portion 63 and solder portion 64) and the second level portion 13 of the land portion 14 are covered with non-conductive paste (N.C.P) 15. The N.C.P 15 melted by the heat applied to the land portion 52 partially flows onto the first level portion 12 of the land portion 14. The solder 64 also melts and partially flows toward the driving electrode 11. The first level portion 12 prevents the solder from flowing down onto the driving electrode 11 and thereby keeps the driving electrode 11 from being corroded by the solder 64. It should be noted, however, that the amount of the solder flowing toward the driving electrode 11 can vary from case to case. The N.C.P 15 is provided to reliably prevent the solder 64 from flowing onto the driving electrode 11 even if a large amount of solder 64 flows toward the driving electrode 11. Further, the N.C.P 15 also serves as an adhesive for enhancing the joining strength between the FPC board 50 and the piezoelectric sheet 10.

Further, when the extended portion 51 of the FPC board 50 is placed on the piezoelectric sheet 10 such that the positioning marks 56 on the FPC board 50 are aligned with the positioning marks 46 on the piezoelectric sheet 10, the contact lands 54 of the FPC board 50 make contact with the dummy electrodes 41 of the piezoelectric sheet 10 formed along the imaginary line L1 and also with the protrusions 33 and 38 of the common electrodes 31 and 36 formed alternately along each oblique sides of the piezoelectric sheet 10. Thus, the contact lands 54 can be electrically connected with the dummy electrodes 41 and the common electrodes 31 and 36 by means of thermo compression, for example.

After the FPC board 50 is connected with the piezoelectric sheet 10 as described above, driving voltage can be applied between the driving electrodes 11 and the inner electrodes 22 and 25 through the FPC board 50 to deform the first, second, third, and forth piezoelectric layers 21, 23, 24 and 26 at portions directly below each driving electrodes 11.

Each portion of the first piezoelectric layer 21 defined immediately below each driving electrode 11 serves as an active portion that bends when voltage is applied to corresponding driving electrode 11.

It should be noted that, since the shrinking percentage differs between the piezoelectric material of the first through fourth piezoelectric layers (21, 23, 24 and 26) and the metallic material of the inner electrodes (22, 25), the piezoelectric sheet 10 may bend or deform into a wavy form during the sintering process thereof. The inner electrode 25 is provided between the third and fourth piezoelectric layers 24 and 26 so as to serve as a restraint layer that prevents the first through fourth piezoelectric layers (21, 23, 24, 26) from bending or deforming into a wavy form, which deteriorates the flatness of the piezoelectric sheet 10. Further, the second, third and fourth piezoelectric layers (23, 24, 26) serve as restraint layers that force the active portions of the first piezoelectric layer 21 to bend only downward (toward the cavity plate 900).

Next, the flow of the ink within the inkjet head 1 configured as described above will be described.

Figure 29:
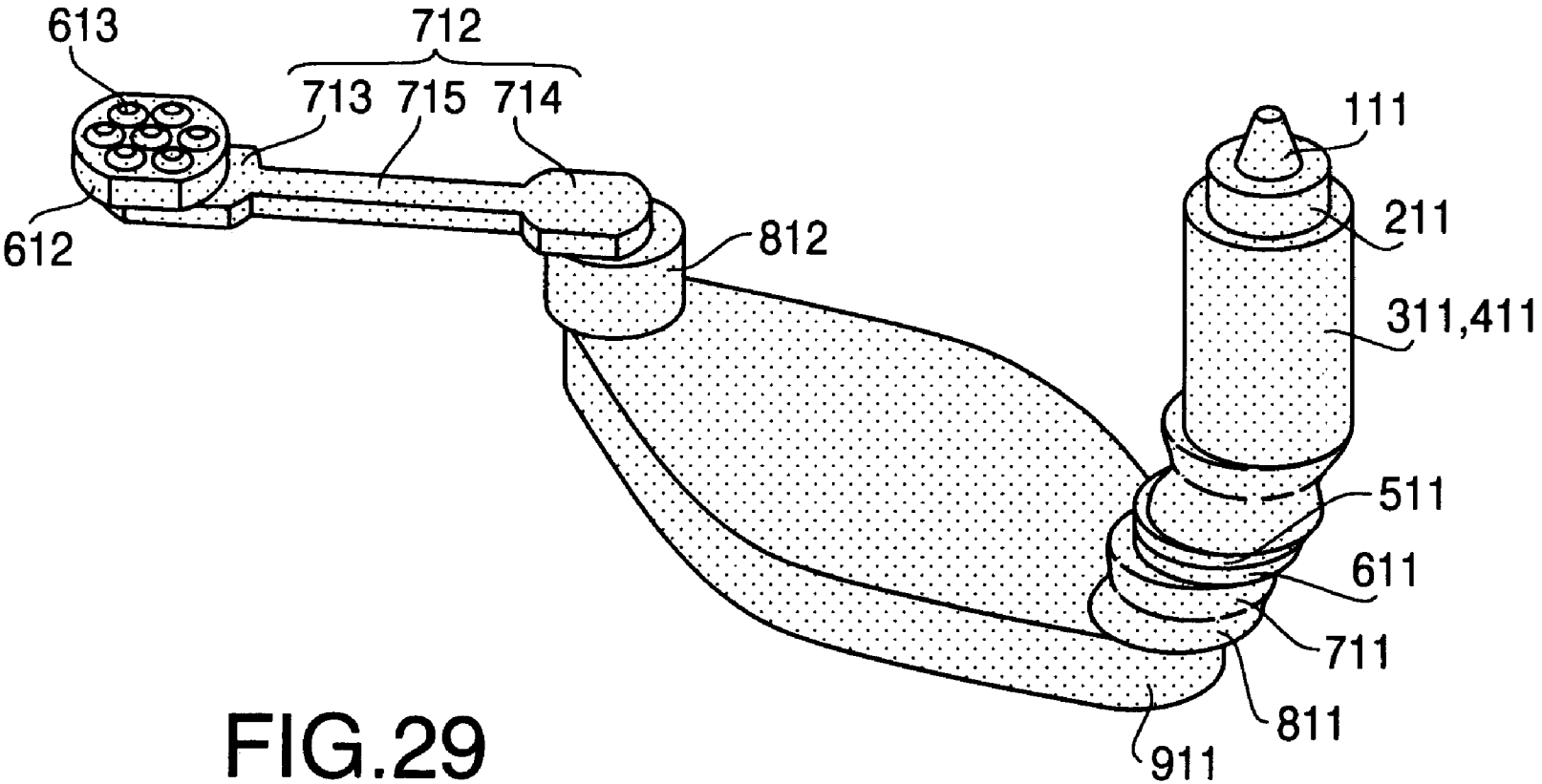
FIG. 29 is a perspective view of the ink channel shown in FIG. 28.
Figure 30:
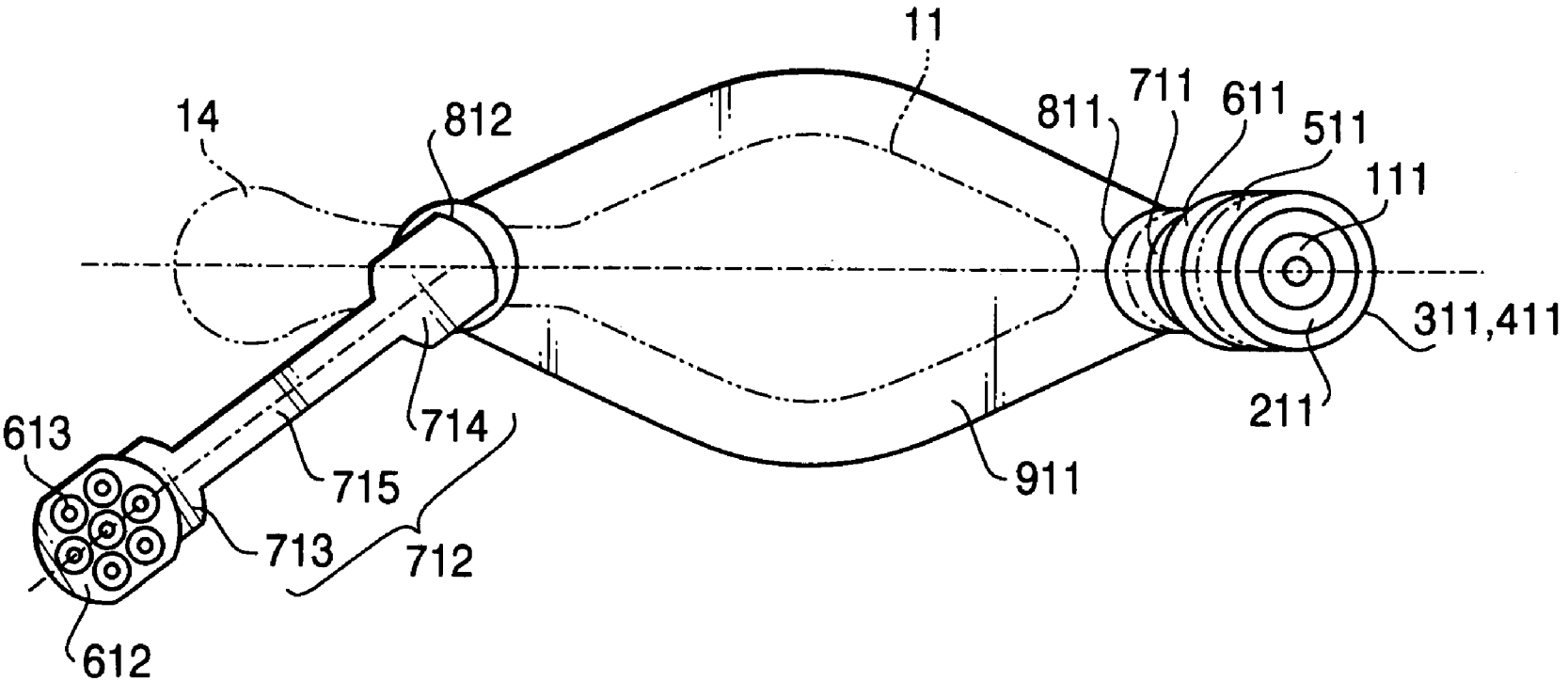
FIG. 30 is a plane view of the ink channel shown in FIG. 29 observed from the nozzle side.

FIG. 28 is a sectional view of a part of the inkjet head 1 showing a part of an ink channel extending from one of the nozzles 111. FIG. 29 is a perspective view the ink channel shown in FIG. 28, and FIG. 30 is a plane view of the ink channel shown in FIG. 29 observed from the nozzle side. Referring now to FIGS. 3, 28, 29, and 30, the ink to be ejected from the inkjet head 1 is first supplied from an ink tank (not shown) into the manifold channels 20 through the ink supply channels each consisting of the ink supply openings 901, 801, 801, 701 and 601 (see FIG. 3). Note that foreign matter within the supplied ink is prevented from entering the manifold channels 20 by the filter holes 602 as the ink flows through the ink supply openings 601 of the supply plate 600 (see also FIG. 13).

Referring to FIG. 28, the side walls of the manifold channels 20 consist of the side walls of the openings 312 of the first manifold plate 300, the openings 412 of the second manifold plate 400, and the openings 512 of the third manifold plate 500. Further, the upper surfaces of the manifold channels 20 are defined by the supply plate 600, while the under surfaces are defined by the cover plate 200.

Figure 31:
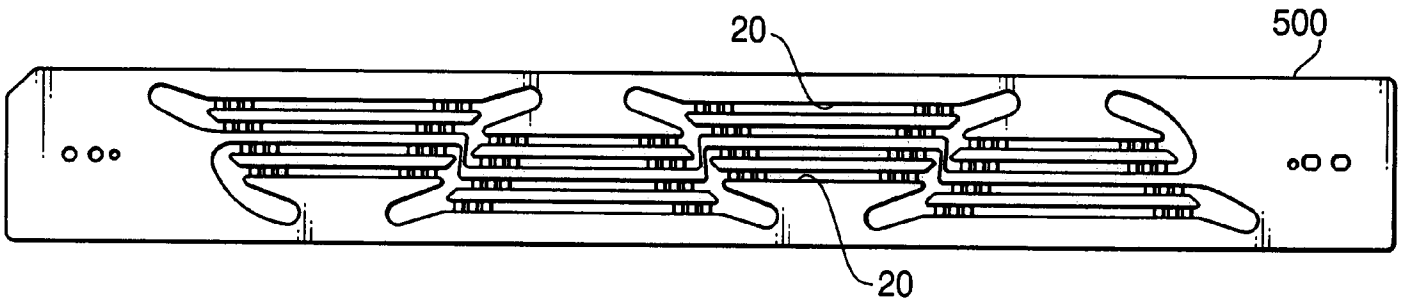
FIG. 31 is a top view of two manifold channels of the inkjet head shown in FIG. 2.
Figure 32:
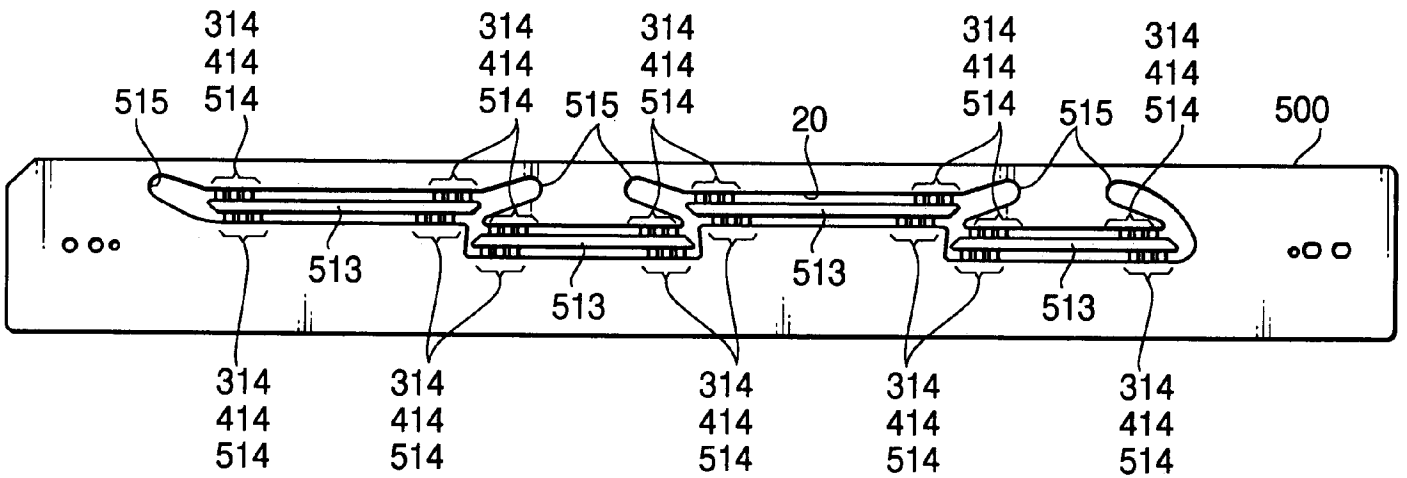
FIGS. 32 and 33 respectively show a top view of one of the manifold channels shown in FIG. 31.
Figure 33:
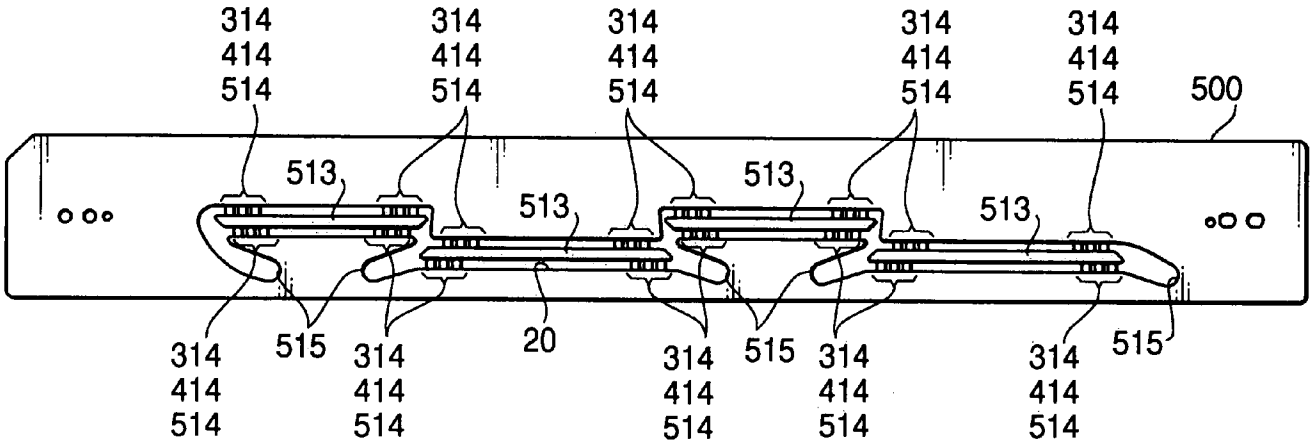

FIG. 31 is a top view of the two of manifold channels 20 formed in the inkjet head 1. As shown in FIG. 31, two manifold channels 20 are formed in the inkjet head 1, one in the right half of the inkjet head 1, as shown in FIG. 32, and the other one in the left half of the inkjet head 1, as shown in FIG. 33. Each manifold channel 20 has five ink supply portions, each consisting of the ink supply portion 515 of the opening 512 of the third manifold plate 500 (see FIG. 9), the ink supply portion 415 of the opening 412 of the second manifold plate 400 (see FIG. 8), and the ink supply portion 315 of the opening 312 of the first manifold plate 300 (see FIG. 7).

Figure 34:
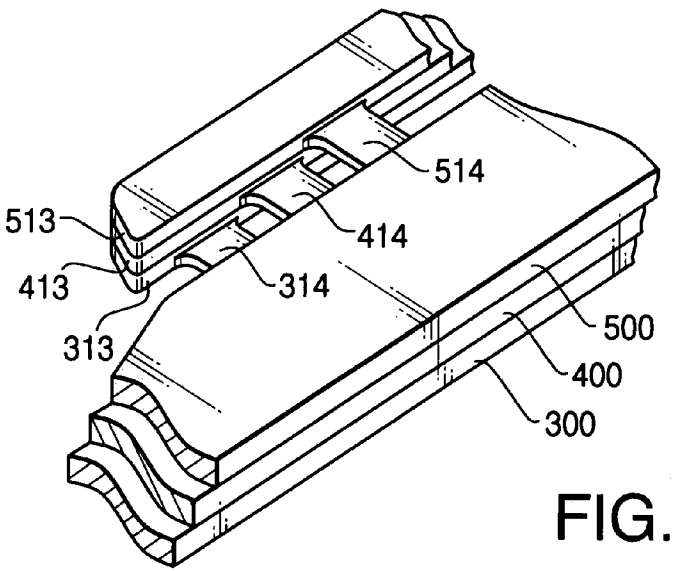
FIG. 34 is a perspective view of a part of the manifold channel.

Further, in each manifold channel 20, the land portions 313, 413, and 513 of the first, second, and third manifold plates 300, 400, and 500 are aligned with each other, as shown in FIGS. 32 and 33, while the connection beams 314, 414 and 514 respectively supporting the land portions 313, 413 and 513 are located so as not to align with each other as shown in FIG. 34.

Accordingly, each manifold channel 20 has four stacks of the land portions (313, 413, 513) therein. In other words, closed loops are formed in the manifold channel 20, each surrounding one of the stacks of the land portions (313, 413, 513). Thus, the ink in the manifold channels 20 can flow around the stacks of the land portions (313, 413, 513).

It should be noted that the connection beams (314, 414, 514) supporting the land portions (313, 414, 514) allow the ink to flow smoothly around the stacks of the land portions (313, 414, 514) since the connection beams (313, 414, 514) are not aligned with each other, as shown in FIG. 34, and also since the connection beams are formed thin by half etching.

Referring back to FIG. 28, the ink flowing within the manifold channels 20 is next introduced into the ink chamber 911 of the cavity plate 900 through the filter portion 612 of the supply plate 600, the restriction portion 712 of the aperture plate 700, and the through hole 812 of the base plate 800. Note that foreign matter has been removed from the ink, and thereby prevented from entering the pressure chamber 911, as the ink flows through the filter portion 612 by the filter holes 613 thereof (see FIGS. 11 and 12).

The upper side of the ink chamber 911 is closed by the piezoelectric sheet 10 attached on the cavity plate 900. The piezoelectric sheet 10 is placed on the cavity plate 900 such that the driving electrodes 11 are located directly above the respective ink chambers 911. The driving electrodes are formed in a size slightly smaller than the ink chambers 911. Thus, as shown in FIG. 30, each of the substantially rhombus driving electrodes 11 is located within a substantially rhombus area right above the corresponding ink chamber 911, if observed from the bottom side of the ink chamber 911. Further, as also shown in FIG. 30, the contact land portion 14 formed on the portion of the driving electrode 11 extending from one acute angle corner thereof is located outside the substantially rhombus area directly above the ink chamber 911.

When driving voltage is applied between the driving electrode 11 and the inner electrodes 22 and 25 of the piezoelectric sheet 10, the piezoelectric sheet 10 deforms (bends) toward the cavity plate 900, thereby pressing the ink in the ink chamber 911. The pressed ink flows through the through holes (811, 711, 611, 511, 411, 311, 211) of the base plate 800, the aperture plate 700, the supply plate 600, the third manifold plate 500, the second manifold plate 400, the first manifold 300, and the cover plate 200, and is ejected from the nozzle 111 of the nozzle plate 100.

It should be noted that, as shown in FIGS. 32 and 33, one of the manifold channels 20 is formed in the right half of the inkjet head 1 in the width direction, while the other manifold channel 20 is formed in the left half. The manifold channel 20 in the right half of the inkjet head 1 is in fluid communication with all of the ink chambers 911 formed on the right half of the cavity plate 900 through the through holes 612 formed on the right half of the supply plate 600. Further, the manifold channel 20 in the left half of the inkjet head 1 is in fluid communication with all of the ink chambers 911 formed on the left half of the cavity plate 900 through the through holes 612 formed on the left half of the supply plate 600. Accordingly, the ink supplied into the manifold channels 20 is distributed to all ink chambers 911 so that the ink can be ejected from any of the nozzles 111.

As described hereinabove, in the inkjet head 1 according to the embodiment of the invention, the contact lands 52 of the FPC board 50 are electrically connected with the land portions 14 of the driving electrodes 11 of the piezoelectric sheet 10 (see FIG. 27). The FPC board 50 provides power from external equipment to the driving electrodes 11 so that the piezoelectric sheet 10 applies pressure to the ink in the ink chambers 911 defined in the cavity plate 900 right below the driving electrodes 11 (see FIG. 28).

The ink chambers 911 are arranged in matrix, as shown in FIG. 17, to achieve a high density arrangement thereof Thus, the driving electrodes 11, which are formed right above the respective ones of the ink chambers 911, are also arranged in a matrix as shown in FIG. 18. As shown in FIGS. 18 and 19, the land portion 14 of each driving electrode 11 is formed in the vicinity of the driving electrode 11, and is located between the adjacent other driving electrodes 11. As a result, the land portions 14 of the driving electrodes are also arranged in matrix. It should be noted that the land portions 14 arranged in a matrix, as described above, do not prevent the driving electrodes 11, and hence the ink chambers 911, from being arranged at high density.

The contact lands 52 of the FPC board 50 are also arranged in matrix and located at positions corresponding to respective ones of the land portions 14 of the piezoelectric sheet 10. Thus, the contact lands 52 of the FPC board 50 can be electrically connected with the land portions 14 of the piezoelectric sheet 10 although the land portions 14 of the piezoelectric sheet 10 are located in the vicinity of the driving electrodes 11 that are arranged in matrix of high density.

It should be noted that each lands portion 14 of the piezoelectric sheet 10 is a protrusion including the first level portion 12, which is higher than the driving electrode 11, and the second level portion 13 that is still higher than the first level portion 12 (see FIG. 20). Thus, when the FPC board 50 is connected with the piezoelectric sheet 10 at the contact lands 52 and the land portions 14, a clearance is created between the FPC board 50 and the piezoelectric sheet 10 that prevents the FPC board 50 from coming into contact with the driving electrodes 11 (see FIG. 27) and applying unintentional force thereon.

It should be also noted that the land portions 14 of the piezoelectric sheet 10, which are small protrusions, reduce the contact area between the FPC board 50 and the piezoelectric sheet 10. Thus, the FPC board 50 can be easily connected to the piezoelectric sheet 10 by means of thermo compression, for example, since large pressure can be generated between the land portions 14 and the contact lands 52 by slightly pressing the FPC board 50 against the piezoelectric sheet 10.

While the invention has been described in detail with reference to specific embodiments thereof, it would be apparent to those skilled in the art that various changes and modifications may be made therein without departing from the spirit of the invention, the scope of which is defined by the attached claims.

For example, each lands portion 14 of the driving electrode 11 may be formed into three-tiers instead of into two-tires having first and second level portions 12 and 13 as shown in FIG. 20.

What is claimed is:

1. An inkjet head, comprising:

a cavity plate having a plurality of pressure chambers arranged in matrix;

a piezoelectric sheet laminated on said cavity plate;

a plurality of driving electrodes formed on said piezoelectric sheet at positions corresponding to said pressure chambers;

a plurality of first contact lands extending from respective ones of said driving electrodes along a surface of the piezoelectric sheet, each of said first contact lands being located in a vicinity of corresponding one of said driving electrodes; and a power supply board having a plurality of second contact lands formed at positions corresponding to said first contact lands, said second contact lands being connected with respective ones of said first contact lands for power supply, wherein said driving electrodes are arranged such that said first contact land extending from one driving electrode is placed between two driving electrodes adjacent to said one driving electrode.

2. The inkjet head according to claim 1, wherein said first contact lands are formed so as to protrude from said piezoelectric sheet.

3. The inkjet head according to claim 1, wherein said second contact lands are formed so as to protrude from said power supply board.

4. The inkjet head according to claim 2, wherein each of said first contact lands is formed in more than two tiers.

5. The inkjet head according to claim 2, wherein each of said first contact lands includes a first level portion higher than said driving electrode and a second level portion higher than said first level portion, said first level portion being formed between said second level portion and said driving electrode.

6. The inkjet head according to claim 5, wherein said second level portion is formed outside of areas of said piezoelectric sheet defined right above said pressure chambers.

7. The inkjet head according to claim 1, wherein each of said driving electrodes has a substantially rhombus form having a pair of acute angle corners and a pair of obtuse angle corners, and wherein said driving electrodes are arranged such that said acute angle corners of one driving electrode is located between said acute angle corners of other driving electrodes adjacent to said one driving electrode.

8. The inkjet head according to claim 7, wherein each of said first contact lands extends from one of said acute angle corners of said driving electrode.

9. The inkjet head according to claim 1, wherein said piezoelectric sheet has at least one positioning mark that assists in positioning of said power supply board on said piezoelectric sheet such that said plurality of first contact lands make contact with said plurality of second contact lands.

10. The inkjet head according to claim 1, wherein said power supply board has at least one positioning mark that assists in positioning of said power supply board on said piezoelectric sheet such that said plurality of first contact lands make contact with said plurality of second contact lands.

11. The inkjet head according to claim 1, wherein the plurality of pressure chambers are arranged in a matrix with more than two rows and more than two columns.

12. An inkjet head, comprising:

a body having a plurality of pressure chambers arranged in matrix;

a piezoelectric sheet attached on said body;

a plurality of driving electrodes formed on said piezoelectric sheet at positions corresponding to said pressure chambers; and a plurality of first contact lands extending from respective ones of said driving electrodes along a surface of the piezoelectric sheet, each of said first contact lands being located in a vicinity of corresponding one of said driving electrodes, said first contact lands being to be connected with respective ones of second contact lands of a printed board for power supply, wherein said driving electrodes are arranged such that said first contact land extending from one driving electrode is placed between two driving electrodes adjacent to said one driving electrode.

13. The inkjet head according to claim 12, wherein said first contact lands are formed so as to protrude from said piezoelectric sheet.

14. The inkjet head according to claim 13, wherein each of said first contact lands is formed in more than two tiers.

15. The inkjet head according to claim 13, wherein each of said first contact lands includes a first level portion higher than said driving electrode and a second level portion higher than said first level portion, said first level portion being formed between said second level portion and said driving electrode.

16. The inkjet head according to claim 12, wherein said first contact lands are formed outside of areas of said piezoelectric sheet defined right above said pressure chambers.

17. The inkjet head according to claim 12, wherein each of said driving electrodes has a substantially rhombus form having a pair of acute angle corners and a pair of obtuse angle corners, and wherein said driving electrodes are arranged such that said acute angle corners of one driving electrode is located between said acute angle corners of other driving electrodes adjacent to said one driving electrode.

18. The inkjet head according to claim 17, wherein each of said first contact lands extends from one of said acute angle corners of said driving electrode.

19. The inkjet head according to claim 12, wherein said piezoelectric sheet has at least one positioning mark that assists in positioning of the printed board on said piezoelectric sheet such that said first contact lands come into contact with the second contact lands.

20. The inkjet head according to claim 12, wherein the plurality of pressure chambers are arranged in a matrix with more than two rows and more than two columns.

* * * * *